US009784092B2

(12) United States Patent
Southgate et al.

(10) Patent No.: US 9,784,092 B2
(45) Date of Patent: Oct. 10, 2017

(54) DOWNHOLE CONTROL DEVICE

(71) Applicant: Spartek Systems UK Limited, Aberdeen, Aberdeenshire (GB)

(72) Inventors: Anthony Southgate, Aberdeen (GB); Fern Chin, Aberdeen (GB); Allan Morrice, Aberdeen (GB); Grzegorz Jurga, Aberdeen (GB)

( * ) Notice: Subject to any disclaimer, the term of this patent is extended or adjusted under 35 U.S.C. 154(b) by 289 days.

(21) Appl. No.: 14/398,054

(22) PCT Filed: May 1, 2013

(86) PCT No.: PCT/GB2013/051125

§ 371 (c)(1),
(2) Date: Oct. 30, 2014

(87) PCT Pub. No.: WO2013/164614

PCT Pub. Date: Nov. 7, 2013

(65) Prior Publication Data

US 2015/0107852 A1 Apr. 23, 2015

(30) Foreign Application Priority Data

May 2, 2012 (GB) ..... 1207713.7

(51) Int. Cl.

| | |
|---|---|
| ***E21B 47/01*** | (2012.01) |
| ***E21B 23/00*** | (2006.01) |
| ***E21B 41/00*** | (2006.01) |
| ***E21B 43/1185*** | (2006.01) |
| ***E21B 33/128*** | (2006.01) |
| ***E21B 47/06*** | (2012.01) |
| ***E21B 47/12*** | (2012.01) |

(52) U.S. Cl.

CPC ..... *E21B 47/011* (2013.01); *E21B 23/00* (2013.01); *E21B 33/128* (2013.01); *E21B 41/00* (2013.01); *E21B 41/0021* (2013.01); *E21B 43/1185* (2013.01); *E21B 47/01* (2013.01); *E21B 47/06* (2013.01); *E21B 47/065* (2013.01); *E21B 47/122* (2013.01)

(58) Field of Classification Search

None

See application file for complete search history.

(56) References Cited

U.S. PATENT DOCUMENTS 4,454,756 A * 6/1984 Sharp ..... E21B 47/022 33/313
4,604,699 A * 8/1986 Borcherdt ..... G01V 1/008 702/15

(Continued)

FOREIGN PATENT DOCUMENTS

WO 2009/009476 A1 1/2009

*Primary Examiner* — Shane Bomar

(57) ABSTRACT

A downhole control device is configured to activate downhole equipment requiring control signals. The device having a housing adapted to protect electronic components; a transducer configured to measure one or more of pressure and temperature; an accelerometer; and control circuitry in communication with the transducer and the accelerometer and configured to control the operation of a downhole tool depending on data from one or more of the transducer and accelerometer. The transducer, the accelerometer and at least part of the control circuitry are mounted on a chassis that is removably inserted within the housing.

15 Claims, 14 Drawing Sheets

(56) References Cited

U.S. PATENT DOCUMENTS

| | | | | |
|---|---|---|---|---|
| 5,299,075 | A * | 3/1994 | Hanks | G11B 5/5582 360/75 |
| 6,778,389 | B1 | 8/2004 | Glovatsky et al. | |
| 2001/0020218 | A1* | 9/2001 | Cosma | G01V 1/005 702/13 |
| 2005/0001735 | A1 | 1/2005 | Hall et al. | |
| 2006/0065395 | A1 | 3/2006 | Snell | |
| 2006/0144619 | A1* | 7/2006 | Storm | E21B 47/011 175/17 |
| 2006/0214664 | A1* | 9/2006 | Folberth | G01V 3/30 324/339 |
| 2007/0056771 | A1 | 3/2007 | Gopalan et al. | |
| 2012/0199031 | A1* | 8/2012 | Lanclos | E21B 43/1185 102/206 |
| 2014/0210633 | A1* | 7/2014 | Hrametz | E21B 47/12 340/854.4 |
| 2014/0312752 | A1* | 10/2014 | Durisotti | E21B 47/011 312/237 |

* cited by examiner

DOWNHOLE CONTROL DEVICE

CROSS-REFERENCE TO RELATED APPLICATIONS

This application is the United States National Phase of PCT Patent Application No. PCT/GB2013/051125 filed on 1 May 2013, which claims priority to British Patent Application No. 1207713.7 filed 2 May 2012, each of which are incorporated herein by reference.

TECHNICAL FIELD

The present invention relates to an apparatus for controlling a downhole tool for wellbore applications.

BACKGROUND OF THE INVENTION

Downhole devices presently used in wellbore applications are typically used for controlling or activating downhole tools, such as data loggers, perforating guns, depth loggers and many other functions in downhole environments.

The downhole environment is well known to be a harsh environment with high pressure and temperature conditions. As such downhole equipment is typically limited to a fixed number of uses before refurbishment of the sensitive or susceptible elements of the downhole equipment is required.

A substantial risk within downhole applications is unexpected or premature control or activation of downhole tools. It is particularly desirable to have reliable safety mechanisms in downhole devices that control or activate detonations, for example for perforation applications, to prevent unexpected detonations such as surface detonations near users of the device which can be fatal.

The premature or incorrect control or activation of downhole tools is known to be an issue with devices that lack physical robustness for the downhole environment such that components of the downhole device fail and cause unexpected downhole tool activation.

Further issues with premature or unexpected activation of downhole tools may arise from incorrect assembly by in-the-field users who are not technically qualified or capable of assembling the devices.

SUMMARY

According to a first aspect of the invention, there is provided a downhole control device configured to activate downhole equipment requiring control signals, the device comprising: a housing adapted to protect electronic components; a transducer configured to measure one or more of pressure and temperature; an accelerometer; and control circuitry in communication with the transducer and the accelerometer and configured to control the operation of a downhole tool depending on data from one or more of said transducer and said accelerometer; wherein the transducer, the accelerometer and at least part of the control circuitry are mounted on a chassis; and wherein the chassis is removably inserted within the housing.

By mounting a transducer, an accelerometer and at least part of the control circuitry on a removably insertable chassis within a downhole control device, the user is able to easily remove and refurbish the sensitive components of the downhole control device. The user is also able to simply insert a new chassis comprising freshly calibrated components to ensure correct operation of the downhole control device.

According to a second aspect of the invention, there is provided an insert configured to be removably inserted into a downhole device, comprising: a chassis; a transducer configured to measure one or more of pressure and temperature; an accelerometer; control circuitry in communication with the transducer and the accelerometer and configured to control the operation of a downhole tool depending on data from one or more of said transducer and said accelerometer; wherein the transducer, the accelerometer and at least part of the control circuitry are mounted on the chassis; and wherein at least part of the control circuitry is calibrated for use with the transducer and the accelerometer.

By providing a calibrated insert, or cartridge, configured to be removably inserted into a downhole device, the user is able to easily replace sensitive components to ensure correct operation of the downhole control device. For reconditioning, only the single unit insertable insert, or the insert inserted in its housing, need be transported to and from the service location. After reconditioning, the calibrated insert may be inserted into its housing section, calibrated, and, optionally, also sealed with the housing before being transported to the use location as a single robust unit. The calibrated insert may even be independently pressure tested to reduce the setup time required at the use location.

As a result, calibration is not required in-the-field. Therefore, by providing a calibrated insert, a more accurate and controlled calibration process may be performed in a controlled environment by users who possess the relevant technical skills. The risk of incorrect activation or control of downhole tools is therefore further reduced by the improved calibration process.

The calibrated insert may be used as a replacement of the internal components of the downhole device that may be sensitive or susceptible to damage within the downhole environment. By providing the calibrated insert, it may be possible to replace the internal components of the downhole device without it being necessary to perform calibration after installation.

According to a third aspect of the invention, there is provided downhole equipment comprising a downhole control device formed as a modular assembly comprising:

a first module comprising a chassis removably insertable into a housing;

an accelerometer, a transducer and control circuitry mounted to the chassis;

a second module comprising a battery;

a detonator; and a safety switch;

wherein the first module is releasably connected to the second module; and wherein the control circuitry is configured to generate a control signal which is transmitted to the detonator.

Providing a modular assembly of the downhole device can further improve compatibility with third party equipment and interchangeable modular components which can therefore be more easily replaced and refurbished without delay to the downhole operation. By providing a transducer and an accelerometer it is possible take measurements of environmental parameters, such as pressure and temperature and acceleration in order to more accurately establish the position and environmental conditions when controlling or activating the downhole tool in order to reduce the risk of incorrect and premature control or activation.

By providing the modular assembly of the downhole device, non-skilled users may robustly assemble and disassemble the downhole device without increasing the risk of premature or unexpected control or activation of a downhole tool as the non-skilled user may not be required to handle, replace or calibrate the sensitive elements of the downhole tool.

According to a fourth aspect of the invention, there is provided a downhole battery module comprising: a casing comprising an internal space configured to securely house a battery; and a conduit between a connector and an endpoint; wherein the conduit is configured to bear at least one signal wire.

The downhole battery module comprising a conduit provides a mechanism to arrange the downhole device in a different arrangement which has the further advantage of circumnavigating problems relating to routing control and communications signals externally to the battery module.

According to a fifth aspect of the invention, there is provided a downhole control device module comprising: a housing adapted to protect electronic components; a chassis removably insertable into the housing; a transducer releasably engaged with an adaptor; and a sub-module configured to releasably connect to an open end of the housing so to form a seal to the external environment.

By providing a downhole control device module with a sub-module and a transducer engaged with an adaptor, it is possible to utilise a single chassis to which is mounted the sensitive elements of the downhole control device which are substantially isolated from the external environment.

According to a sixth aspect of the invention there is provided a method of refurbishing downhole equipment comprising a downhole control device according to the first aspect and a downhole tool wherein the method comprises the step of removing the chassis from the housing and replacing the removed chassis with a replacement chassis to form a downhole control device as described in the first aspect.

According to a seventh aspect of the invention there is provided a method of refurbishing a downhole device wherein the method comprises the step of removing an insert according to the second aspect from the downhole device and replacing the insert with a replacement insert according to the second aspect.

In an eighth aspect the invention provides a method of refurbishing downhole equipment according to the third aspect wherein the method comprises the step of removing the first module according to the third aspect from the downhole equipment and replacing the first module with a replacement first module according to the third aspect.

There is provided a downhole device that may comprise one or more transducers which are configured to measure one or more of pressure and temperature, an accelerometer and control circuitry which is configured to execute and progress through a series of pre-activation modes.

There is provided an insertable chassis configured for insertion into a downhole device.

There is provided an insert configured for insertion into a downhole device.

BRIEF DESCRIPTION OF THE DRAWINGS

The invention is diagrammatically illustrated by way of example, in the accompanying drawings in which.

DETAILED DESCRIPTION OF THE DRAWINGS

Schematic Layout of the Elements of the First Embodiment

Figure 1:
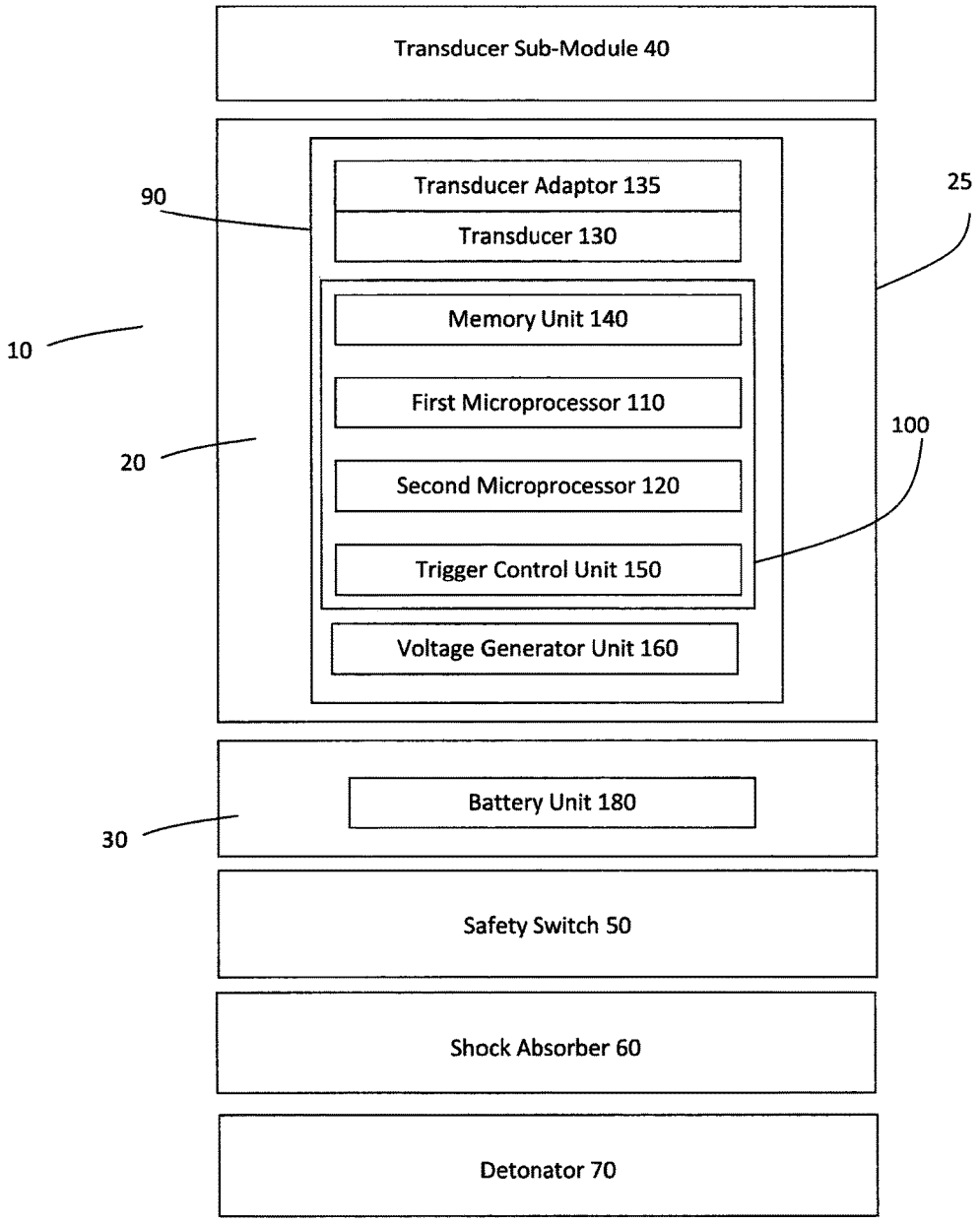
FIG. 1 shows a schematic layout of the elements of the downhole device of a first embodiment of the present invention.

FIG. 1 shows a schematic layout of a downhole control device 10 in accordance with a first embodiment of the invention. In accordance with this arrangement, the downhole device 10 is configured to control a downhole tool. The control of the downhole tool is done by transmitting a control signal to the downhole tool. In the first embodiment of FIG. 1, the downhole tool may be a detonator 70, such as a perforating gun. In accordance with the embodiment of FIG. 1, the downhole device 10 comprises a plurality of modules arranged to form a modular assembly as shown in FIG. 1.

The downhole device 10 of FIG. 1 comprises a main module 20, a battery module 30, a safety switch 50 and a shock absorber 60.

The main module 20 comprises a housing 25 that forms an outer casing to protect the internal components of the main module 20. The housing 25 is preferably formed as a hollow elongate member configured to receive a chassis 90 and engage with a transducer sub-module 40 to seal one end of the main module 20. The housing 25 is preferably cylindrical. In some embodiments, the housing 25 is open at both ends in order to receive a chassis 90. The housing 25 is configured to be sealed at one or both ends for use in downhole environments.

The housing 25 of the main module 20 is configured for use in harsh downhole environments. The housing 25 is configured to house the sensitive elements of the downhole device 10 that are typically vulnerable to the environmental pressure and/or temperature of the external downhole environment. In some embodiments, the housing 25 of the main module is resistant to harsh environmental conditions and as such may be formed of materials that are compliant with NACE standards, such as NACE MR01-75. The external housing or other elements of other modules of the downhole device 10 which are exposed to the downhole environment may also be formed of materials that are compliant with NACE standards, such as NACE MR01-75.

For example, in some embodiments, the assembled main module 20 may be configured to maintain its physical integrity at pressures exceeding 15,000 psi, preferably 20,000 psi, more preferably 25,000 psi and still more preferably at pressures exceeding 30,000 psi. Optionally, temperature resilience may be at temperatures exceeding 50° C., preferably 100° C. and even more preferably at temperatures exceeding 200° C. As such the externally exposed elements of the main module 20 may be configurable to withstand extremely demanding operating conditions.

In alternative embodiments, the main module 20 is configured to maintain its physical integrity at lower pressures, such as at 15,000 psi. In order to withstand these less demanding conditions, in some embodiments the housing 25 of the main module 20 may be formed of a durable material such as 17-4 PH Stainless Steel. In other embodiments, the housing 25 may be made from other materials that are NACE compliant, such as to NACE MR01-75.

It will be appreciated that in other embodiments, the shape of the main module 20 will depend upon the application of the downhole device 10. It will further be appreciated that selecting different shapes of housing 25, such as rectangular, may be envisaged. Further, in some embodiments, the housing 25 of the main module 20 may be open only at one end and closed at the other, such that the housing 25 of the main module 20 may be formed with an integral seal at the closed end.

In the embodiment of FIG. 1, the chassis 90 is formed as a single elongate member configured to support and secure a number of different elements of the downhole device 10, as described in more detail below. As highlighted above, the chassis 90 is assembled into the main module 20 and is environmentally sealed from the harsh external environment of downhole applications. Therefore, it is not necessary for the chassis 90 to be formed of the same material as the housing 25 of the main module 20. In some embodiments, the chassis 90 is formed of a lightweight, durable material. In some embodiments, the chassis 90 is formed of metal. In some embodiments, the chassis 90 may be formed of aluminium. Generally, the chassis 90 is configured to be removably insertable into the main module 20 for an additional layer of protection. Preferably the chassis 90 engages so as to be locked in position within the main module 20.

The downhole device 10 further comprises a battery module 30. The external housing of the battery module 30 forms a casing that may protect the battery module 30 from the external environment. In some embodiments, the housing of the battery module 30 may be formed as a hollow cylinder of similar diameter to that of the main module 20. In other embodiments, as with the main module 20, the battery module 30 may be formed in other shapes, such as rectangular. The main module 20 and the battery module 30 are typically linearly arranged to fit within the wellbore.

The main module 20 is configured to releasably engage at a threaded portion with the battery module 30 so as to environmentally seal the adjacent ends of the two modules. In some embodiments, the releasable engagement between the battery module 30 and the main module 20 may be formed such that an electrical connector 35 is mated, for example in a plug-socket arrangement. One half of the plug-socket arrangement may be formed as part of the main module 20 and the other half of the plug-socket arrangement may be formed as part of the battery module 30.

In some embodiments, by forming an environmental seal at a threaded portion of the main module 20 and the battery module 30 the electrical connector 35 may be isolated from the external environment when the main module 20 and the battery module 30 are engaged. In these arrangements, a specific Ingress Protection (IP) rating is not required for the electrical connector 35. However, in some embodiments, the electrical connector 35 may be rated to ensure integrity and correct operation at temperatures exceeding 200° C.

In some embodiments, the connector 35 may conform to the necessary specifications for the downhole environment, such as the Ingress Protection (IP) Rating. In some embodiments, the connector may be IP68 rated. In some embodiments, the electrical connector 35 may be formed by a LEMO™ connector or an alternative suitable connector.

The battery module 30 may preferably be connected to the main module 20 in a linear arrangement, as shown in FIG. 1. This linear arrangement, where the modules are positioned substantially in a line along a central axis when they are engaged, is particularly suitable for downhole applications as the required bore of the hole is reduced by aligning the modules.

Figure 2:
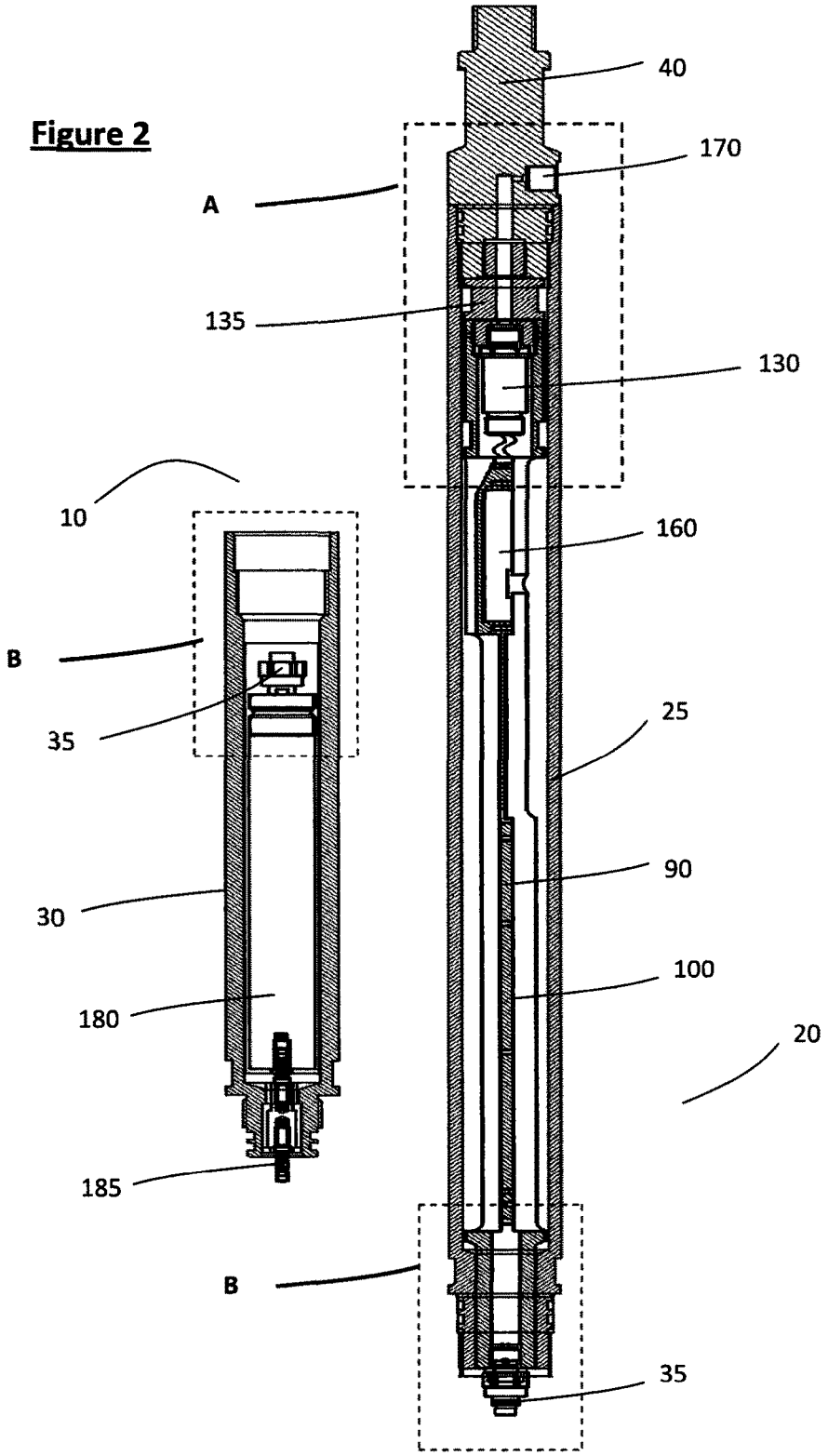
FIG. 2 shows a side view of the downhole device of FIG. 1.

The battery module 30 comprises a battery unit 180 which is configured to be detachably insertable into the battery module 30. The battery unit 180 is configured to generate electrical power to the various electrical components of the downhole device 10. In some embodiments, the battery unit 180 may be a sealed unit with an electrical connector 35 at a first end for connection with the main module 20, as shown in FIG. 2. In some embodiments the battery unit 180 may comprise a lithium sulfuryl chloride cell.

The downhole device 10 further comprises a transducer sub-module 40 which acts as an end cap to seal one end of the main module 20. The transducer sub-module 40 is configured to be releasably connected to the housing 25 at a first end of the main module 20 in order to form a seal at the first end of the main module 20 with a pressure port 170 to allow at least one of environmental pressure and temperature to be sensed and measured by the transducer 130. In some embodiments, the transducer sub-module 40 may be configured to be connected to the first end of the main module 20 by a threaded portion, as will be described later.

The downhole device 10 further comprises control circuitry 100 that is configured to control the downhole device and to receive signals from a transducer 130 and an accelerometer 190. The chassis 90 may further be configured to mechanically support at least part or all of the control circuitry 100 within the main module 20.

The control circuitry 100 comprises electronic circuitry that is configured to process measurements of environmental parameters from one or both of the transducer 130 and the accelerometer 190. The control circuitry 100 is configured to generate a control signal based upon the data from the transducer 130 and the accelerometer 190. The control signal is used to control the downhole tool, either directly or indirectly. In some embodiments, the control signal generated by the control circuitry 100 is an electrical low voltage control signal 210. In some embodiments, the low voltage control signal 210 may be in the form of a square wave signal.

It will be appreciated that the elements of the control circuitry 100 described herein, and demonstrated in FIG. 1, merely represent different functional elements performed within the control circuitry 100. It will therefore be appreciated that the skilled person is capable of incorporating the functionality of the control circuitry 100 into a number of different physical arrangements and using different technical solutions in the form of different electrical circuits. In particular, the skilled person is capable of arranging the functionality onto a number of different physical arrangements of printed circuit boards (PCBs). The design or selection of the layout of the electronics and arrangement of the electronic circuitry will typically be based upon the physical and cost limitations of the specific application.

In some embodiments, the control circuitry 100 may be configured to be resistant to extremes of electrical surges such as lightning strike and high DC voltage, such as from arc welding. In some embodiments, the control circuitry 100 may be configured to operate in conditions with high electromagnetic radiation such as RF signals.

As shown in FIG. 1, the control circuitry 100 comprises a memory unit 140, a first microprocessor 110, a second microprocessor 120 and a trigger control unit 150. The control circuitry 100, or at least a significant portion of the control circuitry 100, may be mounted on the chassis 90 such that it is mechanically supported by the chassis 90. In some embodiments, the chassis 90 may be configured to accommodate the electrical interconnections between the elements of the control circuitry 100, such as the wiring looms that allow the functional elements of the control circuitry 100 to communicate. In some embodiments, the control circuitry 100 may be formed on PCBs which are directly mounted to the chassis 90 in releasable engagement, for example using fixings such as screws. In some embodiments, the fixings may be configured to be resistant to the vibrations of transport and use in the downhole environment. The interaction of the functional elements of the control circuitry 100 is discussed in further detail later.

In some embodiments, including the embodiment of FIG. 1, the chassis 90 may be configured to further mechanically support a voltage generator unit 160. The voltage generator unit 160 is an electrical circuit that may be in communication with the trigger control unit 150 of the control circuitry 100. The voltage generator unit 160 may be configured to convert the low-voltage control signal 210 from the control circuitry 100 to a high-voltage control signal 200.

It will be appreciated that the low voltage control signal 210 refers to an electronic signal of a typical voltage generated within electronic communications systems, for example 3.3V, 5V, 10V or 12V. It will also be appreciated that other voltages can be for the used for the low voltage control signal 210. It will be further appreciated that the high voltage control signal 200 refers to an electronic signal of a voltage suitable for the controlling or activating the downhole tool used in that embodiment. For example, in embodiments where the downhole tool is a detonator 70, the voltage and configuration of the high voltage control signal 200 is suitable for controlling or activating the detonator 70. In some embodiments, the high voltage control signal 200 may have an AC or a DC operating voltage. In some embodiments, the output voltage of the high voltage control signal 200 may range be in the range 18V to 400V. In some embodiments, the high voltage control signal 200 may have a voltage above 400V.

In some embodiments, including the embodiment of FIG. 1, the high voltage control signal 200 generated by the voltage generator unit 160 is transmitted from the output pin 185 of the battery module 30 to a safety switch 50. The safety switch 50 may comprise a mechanical switch which prevents or allows control of the downhole tool, such as the detonator 70, by the high voltage control signal 200. In some embodiments, the safety switch 50 may comprise two mechanical switches; a pressure switch and a temperature switch. Each mechanical switch has an operating range or threshold to ensure that the high voltage control signal 200 is not transmitted to the downhole tool in error. Put another way, the safety switch 50 ensures that the high voltage control signal 200 is transmitted through the safety switch 50 only in the intended operating range or environment.

In an exemplary arrangement, the temperature switch of the safety switch 50 may allow a connection to the next module in the linear arrangement of downhole device 10, such as the shock absorber 60, only if the environmental temperature exceeds a pre-set temperature of 55° C. In some embodiments, the environmental pressure and temperature must either be less than or exceed a pre-set pressure and a pre-set temperature before the switches of the safety switch 50 are closed and the high voltage control signal 200 is transmitted through the switch 50. In some embodiments, the safety switch 50 may be connected to the electrical ground, GND, when in the open position to minimise the risk that the control signal 200 may be transmitted beyond the safety switch 50.

In some embodiments, the transducer 130 may be configured to releasably engage with a transducer adaptor 135. The transducer adaptor 135 may then also be configured to releasably engage with the chassis 90 of the main module 20. The transducer sub-module 40 may then releasably engage the housing 25 of the main module 20 to form a seal to the external environment at the adjacent end of the housing 25.

In the assembled downhole device 10, the transducer sub-module 40 at a first end of the main module 20 and the battery module 30 at the opposite end of the main module 20 connect to the main module to substantially form seals in order to substantially seal the entire main module 20. As a result, the internal elements of the main module 20, such as the chassis 90 and the control circuitry 100 are not exposed to the external downhole environment. Thus, it is not necessary to use the same construction material and mechanical tolerances for the externally exposed elements of the main module 20, such as the housing 25 and transducer sub-module 40, as for the internal elements of the main module 20, such as the chassis 90 and the control circuitry 100.

FIG. 2 shows a side view of the elements of the downhole device 10 according to the first embodiment of the invention. As shown in the FIG. 2, the battery unit 180 may be formed so that it can be inserted into the battery module 30.

In some embodiments, the battery unit 180 may be cylindrical in shape so as to co-operate and be inserted into the battery module 30. In some embodiments, the battery unit 180 may be formed with a recessed base that comprises an integral electrical connector for connection to the output pin 185 of the battery module 30. The integral connector is configured to releasably attach to the output pin 185 of the battery module 30. The releasable electrical connection on the base of the battery unit 180 may be configured to provide mechanical support to the battery unit 180.

The connector 35 located at the opposite end of the battery module 30 to the output pin 185 and indicated by the portion B of FIG. 2 may be configured to detachably connectable to the corresponding portion B indicated on the main module 20. In some embodiments, the connector 35 shown in the portion B may be one half of a plug-socket connector to provide an electrical connection between the modules.

In some embodiments, the connector 35 may be configured to mate five or more pins in order to pass electrical signals between the main module 20 and the battery module 30. In some embodiments, the electrical signals passed between the main module 20 and the battery module 30 may include a battery voltage ($V_b$) 220 in addition to an electrical ground (GND) connection 240 between the battery unit 180 and the control circuitry 100.

In some embodiments, including the embodiment of FIG. 2, the connector 35 between the main module 20 and the battery module 30 may transmit the high voltage control signal 200 generated by the voltage generator unit 160 to the battery module 30. The high voltage control signal 200 generated by the control circuitry 100 may then be typically carried along a shielded cable through a conduit defined in the battery module 30. Preferably, the shielded cable may be sufficiently rated for the electrical current that is carried.

In some embodiments, the shielded cable may be positioned to extend a conduit defined along the external shell of the battery unit 180, between the housing of the battery module 30 and the battery unit 180. In some embodiments, the shielded cable is secured against the external shell of the battery unit 180 by a heat-shrink material to minimise any damage to the cable that carries the control signal 200 generated by the voltage generator unit 160.

In the embodiment of FIG. 2, the control signal that passes from the main module 20 to the battery module 30 is a high voltage control signal 200 that is generated by the voltage generator unit 160. In this embodiment, the control circuitry 100 is configured to generate a low voltage control signal 210 which is transmitted to the voltage generator unit 160. The voltage generator unit 160 may then be configured to generate the high voltage control signal 200. In some embodiments, including the embodiment of FIG. 2, the high voltage control signal 200 generated by the voltage generator unit 160 is suitable for firing a detonator 70. Therefore, in the embodiment of FIG. 2, the electrical signal that passes through the battery module 30 is a high voltage control signal 200.

However, in other embodiments, some of which are described in more detail later, the voltage generator unit 160 is not mounted to the chassis 90 and may be formed within a separate module in operation. In these embodiments, the low voltage control signal 210 that is generated by the control circuitry 100 is passed through the connector 35 between the main module 20 and the battery module 30 and runs through the battery module 30 using the same physical connection used for the high voltage control signal 200 in the embodiment of FIG. 2.

Transducer Sub-Module, Transducer and Chassis

Figure 3:
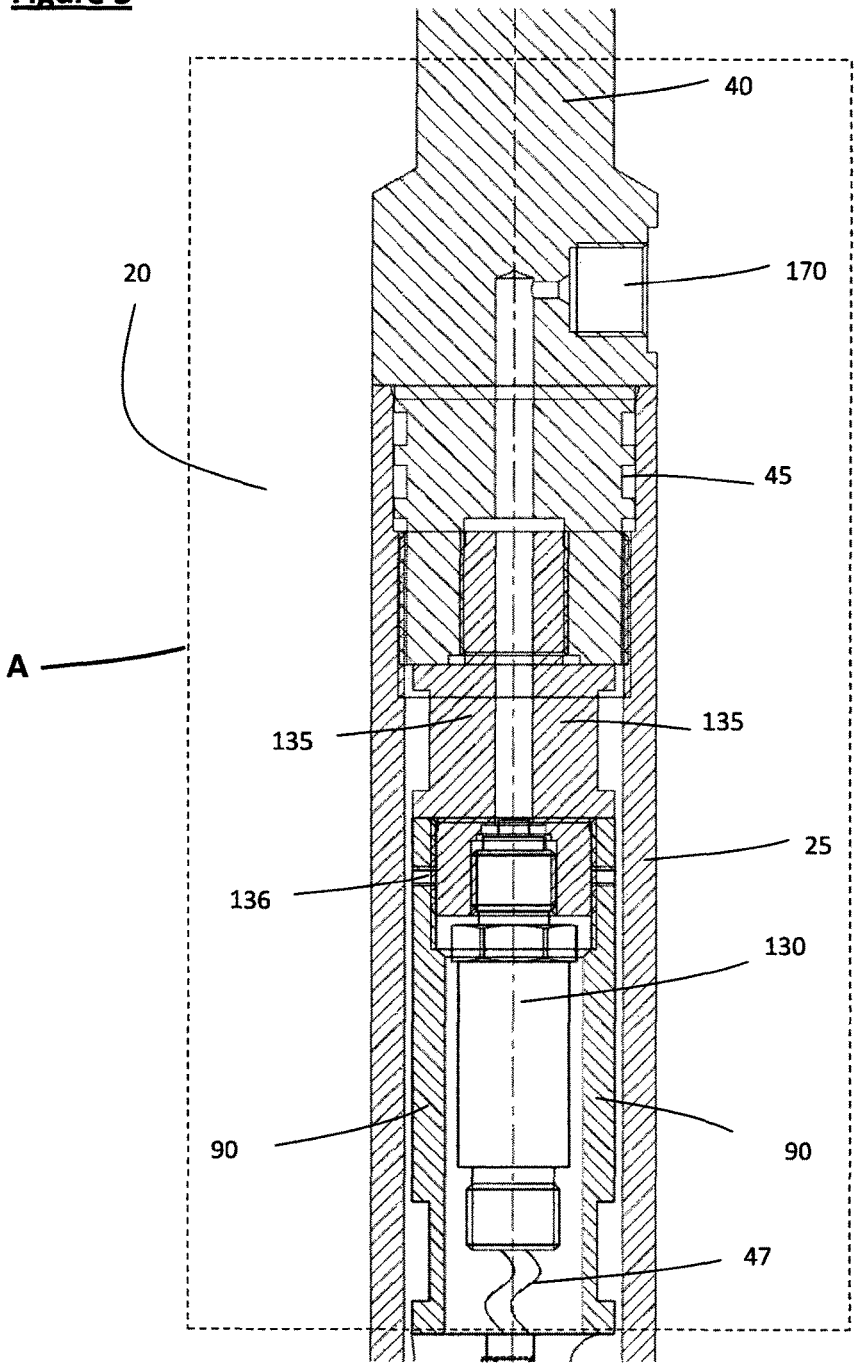
FIG. 3 shows an enlarged side view of the highlighted portion A of the downhole device of FIG. 2.

FIG. 3 shows an enlarged view of the portion A of FIG. 2 according to a first embodiment of the downhole device 10. Portion A depicts one arrangement of the mechanical connection of the transducer sub-module 40, the chassis 90 and the housing 25 of the main module 20.

The transducer sub-module 40 is effectively an end-cap configured for attachment to one end of the downhole device 10. The shape and configuration of the transducer sub-module 40 may differ depending upon the application.

The housing 25 may be configurable to receive the transducer sub-module 40 and to releasably engage the transducer sub-module 40 at a threaded portion 45. The transducer sub-module 40 may be configured with a cooperative threaded portion to engage the housing 25 of the main module 20 at the threaded portion 45. The releasable engagement of the transducer sub-module 40 and the housing 25 may be configured to form a seal that substantially isolates the internal elements of the main module 20, such as the chassis 90 and the control circuitry 100, from the downhole environment. In some embodiments, the portion 45 may comprise two or more notched grooves, as shown in FIG. 3, which may be configured to receive sealing rings that, when assembled, operate to form the seal that isolates the internal elements of the main module 20 from the external environment. In some embodiments, the sealing rings may be formed as O-rings and backup rings.

The transducer sub-module 40 further comprises a pressure port 170 on an external surface. The transducer sub-module 40 may further comprise a hollow channel that passes through the transducer sub-module 40 and is in pressure communication with the pressure port 170. The other end of the hollow channel is in pressure communication with the transducer 130 so as to provide a pressure pathway from the external environment. The pressure pathway that is formed between the pressure port 170 and the transducer 130 presents external pressure to the transducer 130 allowing the transducer 130 to measure the external environmental pressure.

In some embodiments, the transducer 130 may be configured to additionally or alternatively measure external environmental temperature. The transducer 130 may be configured to measure the temperature presented to the transducer 130 through the pathway provided by the pressure port 170. In some embodiments, the transducer 130 may comprise a temperature-sensing crystal which may be configured to generate an output voltage which is indicative or representative of the measured temperature. In some embodiments, the crystal may be physically integrated into the transducer 130. In some embodiments, the output voltage of the temperature-sensing crystal may be in the order of mV. In some embodiments, the output voltage of the crystal may be transmitted through electrical cables 47.

In other embodiments, temperature measurements may be taken elsewhere in the downhole device 10, such as by using a board mounted temperature sensor formed on a PCB as part of the control circuitry 100.

In some embodiments, the first microprocessor 110 may be configurable to receive data relating to one or more of measured pressure and temperature from the transducer 130, or elsewhere in the control circuitry 100, in order to execute a control sequence, described in more detail later.

The mechanical tolerances of the elements of the downhole device 10 that are exposed to the downhole environment, such as the housing 25 and the transducer sub-module 40, may be selected to increase the durability of the environmental seal formed by the mechanical engagement of the housing 25 and the transducer sub-module 40. By increasing mechanical tolerances of these components, it is then possible to manufacture the remainder of the internal elements of the main module 20 to a lower mechanical tolerance as they are not required to form a seal to the external environment and may not be required to withstand downhole environmental constraints.

In some embodiments, the downhole device 10 may be configured to withstand pressure in excess of 15,000 psi. In these embodiments the transducer sub-module 40 may be formed of a graded stainless steel such as SS 17-4 or an equivalent material. In these arrangements the transducer adaptor 135 may be formed of K-Monel or an equivalent material. In these arrangements the chassis 90 may be formed of aluminium or an equivalent material.

In some embodiments, the downhole device 10 may be configured to withstand pressure in excess of 30,000 psi. In these arrangements, the transducer sub-module 40 may be formed of a graded stainless steel such as SS 17-4, which may be configured with a higher yield strength than for embodiments that are configured to withstand pressure in excess of 15,000 psi. In these arrangements, the transducer adaptor 135 may be formed of a material such as Inconel 718 or an equivalent material. In these embodiments, the chassis may also be formed of aluminium or an equivalent material.

In some embodiments, such as lower pressure embodiments, the transducer sub-module 40, the transducer adaptor 135 and the chassis 90 may be formed of equivalent materials to the embodiments configured to 15,000 psi or alternatively may be formed of lower grade materials.

In some embodiments, the pressure port 170 may further comprise a filter, such as a mesh filter, which is configurable to prevent blockage of the pressure port 170 by restricting the flow of unwanted materials into the pathway defined through the transducer sub-module 40. In some embodiments, the filter may be secured with respect to the pressure port 170 using a locking cap.

Figure 6:
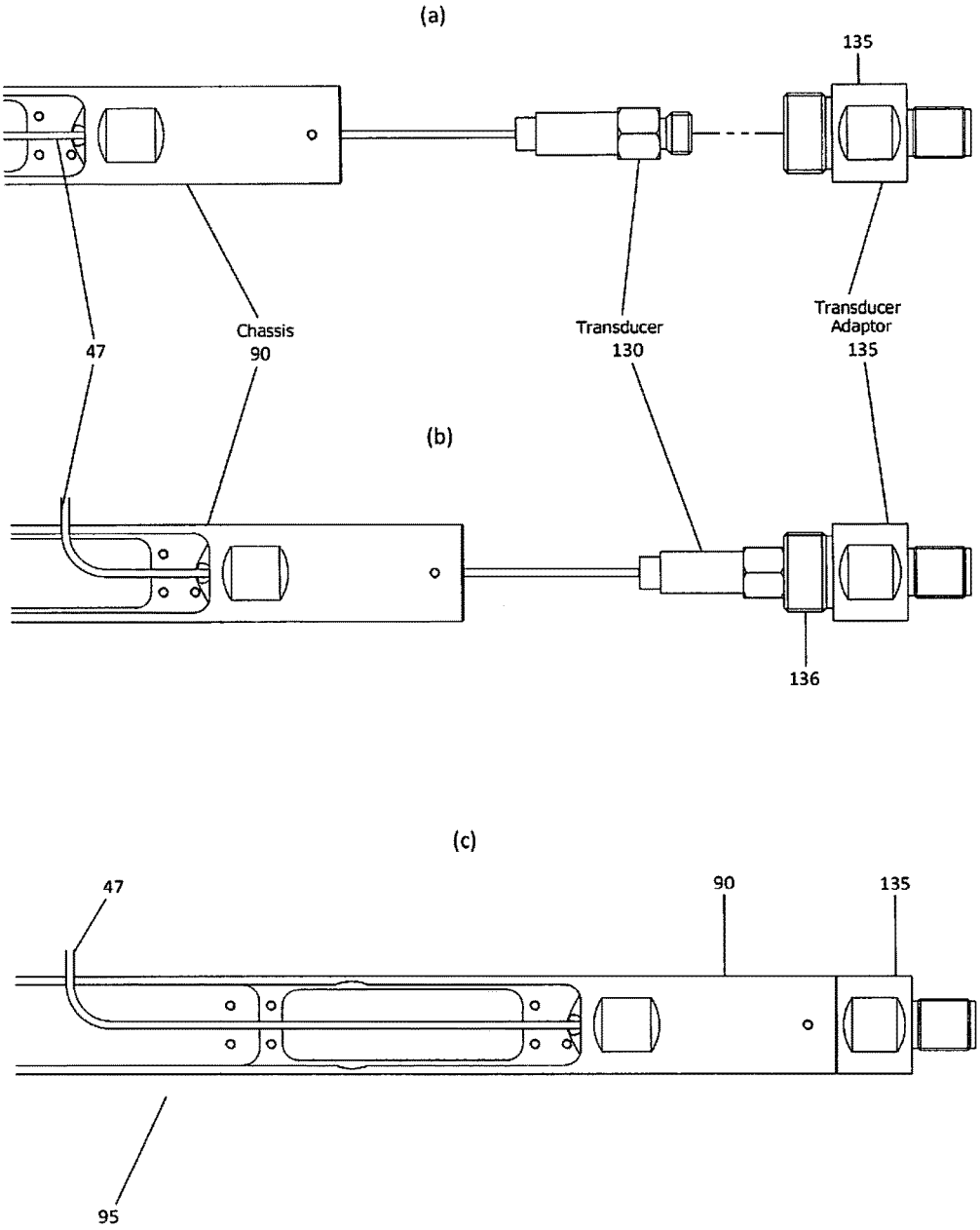
FIG. 6 shows the chassis, transducer and transducer adaptor of the downhole device of FIGS. 1 to 5.

The assembly of the chassis 90 shown in FIG. 3 is shown in more detail in FIGS. 6(*a*) to 6(*c*). As shown in FIG. 6, the transducer 130 may be configured with a threaded portion at an end adjacent to the transducer adaptor 135. The transducer adaptor 135 may be configurable to receive the transducer 130 such that they are releasably engaged by the thread to a pre-specified torque. By engaging the transducer 130 and the transducer adaptor 135, a pressure pathway between the transducer entry port and the channel defined in the transducer adaptor 135 may be established.

As discussed earlier, the transducer adaptor 135 is isolated from the external environment by a seal formed between the transducer sub-module 40 and the housing 25 at the portion 45 of the transducer sub-module 40. In addition to this, the transducer adaptor 135 and the transducer sub-module 40 form an internal seal within the housing 25 of the main module 20 in order to define a pressure pathway between the entry port of the transducer 130 and the pressure port 170 of the transducer sub-module 40.

The electrical cables 47 form an electrical connection between the transducer 130 and control circuitry 100 is established at the opposite end of the transducer 130 to the transducer adaptor 135, as shown in FIG. 3. Therefore, the electrical communication between the transducer 130 and the control circuitry 100 that is mounted on the chassis 90 of the housing 25 operates without having to pass through or disturb the seal established by the transducer adaptor 135 and the transducer sub-module 40 and the other seal formed by the transducer sub-module 40 and the chassis 25.

Figure 4:
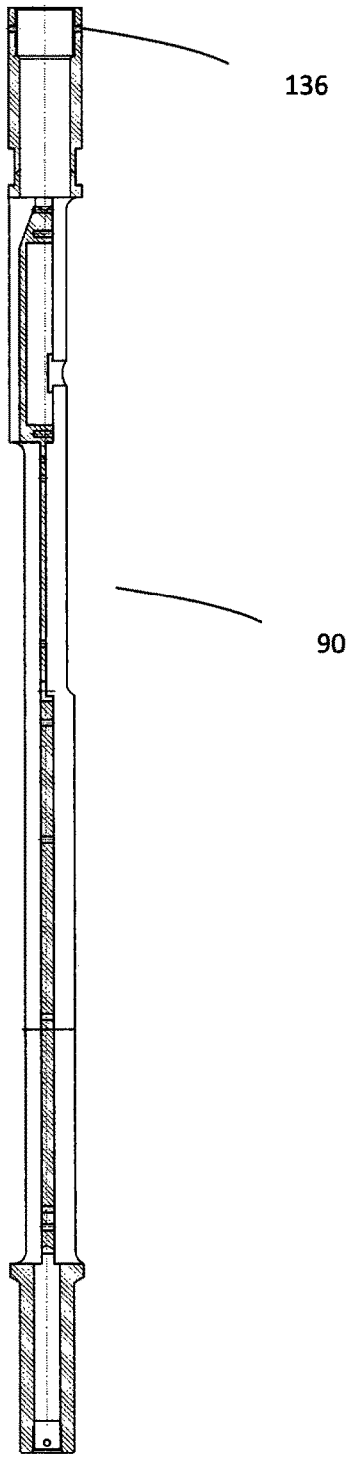
FIG. 4 shows a side view of the chassis of the downhole device of FIGS. 1 to 3.

As shown in FIG. 4 and highlighted in more detail in FIGS. 6(*a*)-(*c*), the chassis 90 comprises an integral hollow portion at one end of the chassis 90. In the embodiment of FIG. 6 (*a*), the hollow portion may be formed as a hollow cylinder. In other embodiments, the hollow portion may additionally or alternatively be formed in other shapes.

As shown in FIGS. 6(*a*)-(*c*), the transducer 130 may comprise electrical cabling that is configurable to connect to and communicate with the control circuitry 100. When the transducer 130 is mounted to the chassis 90, the cabling may be fed through the hollow portion of the chassis so that when the chassis 90 is inserted into the housing 25 of the main module 20, so as to reduce the risk of the cabling of the transducer 130 being damaged or trapped. This is shown in further detail in FIG. 6(*b*).

After the cabling of the transducer 130 has been laid through the hollow portion of the chassis 90, the transducer 130 and the attached transducer adaptor 135 may be inserted into the chassis 90 and may be releasably engaged thereto. A threaded portion 136 on the transducer adaptor 135 may be configured to engage a co-operative threaded portion of the chassis 90 in order to be attached to the chassis 90. The transducer 130 and the transducer adaptor 135 may be releasably engaged with the chassis 90 at the threaded portion to a pre-specified torque. The transducer adaptor 135, attached to the transducer 130, may then be further releasably secured to the chassis 90 using fixings such as grub screws. The elements described form a single assembled chassis unit shown in FIG. 6(*c*). The single assembled chassis unit, an example of which is shown in FIG. 6(*c*) may comprise the assembled chassis 90, the transducer 130, the transducer adaptor 135 and the mounted control circuitry 100. In this arrangement, the assembled chassis unit forms a cartridge 95.

The single chassis element formed as a cartridge 95 may then comprise the components that are device that may be used in operation to generate the control signal. As a result, the cartridge 95 may be assembled and optionally may then be calibrated prior to insertion into the housing 25 of the main module 20 for operation to allow ease of replacement of the cartridge 95. The cartridge 95 operates as an insert for the downhole tool. In other terms the cartridge 95 operates as a cassette, such that the cartridge may be a sub-assembly that may be configured for simple insertion into and/or removal from the downhole device 10.

In some embodiments, the cartridge 95 may comprise the control circuitry 100, the transducer 130 and the transducer adaptor 135 mounted or secured to the chassis 90. In some embodiments, the cartridge 95 may comprise additional components, such as the electrical connector 35. In some embodiments, such as the first embodiment, the cartridge 95 may comprise the voltage generator unit 160.

Figure 5:
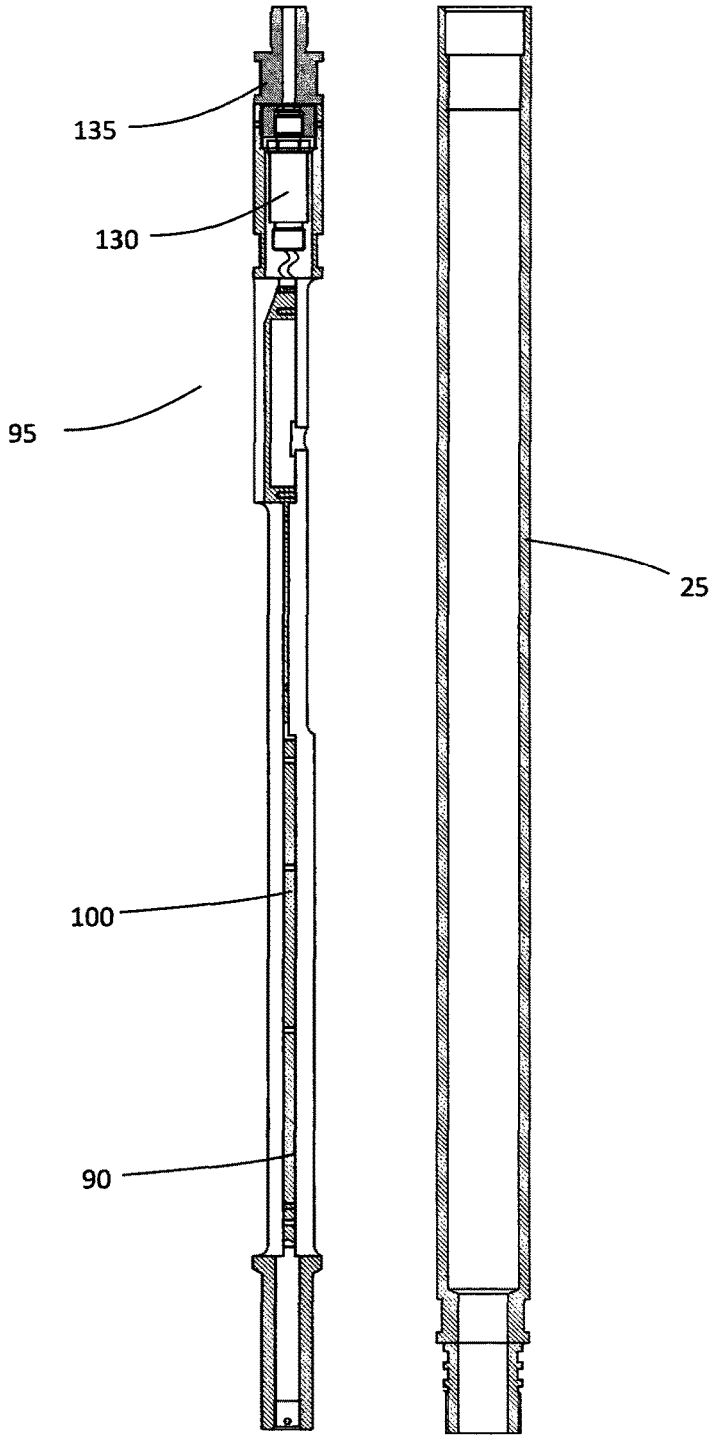
FIG. 5 shows a side view of the cartridge and the housing of the downhole device of FIGS. 1 to 4.

An exemplary cartridge 95 is shown in detail in FIG. 5. As shown in this arrangement, the cartridge 95 comprises the chassis 90, such as is shown in FIG. 4. The control circuitry 100, the transducer 130 and the transducer adaptor 135 may be mounted on or engaged with the chassis 90 as shown in FIG. 5 to form the cartridge 95. The cartridge 95 is shown in FIG. 5 to be adjacent to the housing 25 of the main module 20. The cartridge 95 is configured for insertion into the housing 25 to form an arrangement such as shown in FIGS. 2 and 3.

Calibration and Pressure Testing

When the cartridge 95 is assembled to comprise the transducer 130 the transducer sub-module 40 and the control circuitry 100 mounted upon it, the chassis 90 is insertably engageable within the housing 25 of the main module 20. The assembled cartridge 95 may comprise the associated control circuitry 100, the transducer 130, the transducer adaptor 135 and the accelerometer 190. Therefore, it is possible to pressure test and calibrate the control circuitry 100 prior to insertion into the downhole device 10. Optionally, it may be possible to pressure test and calibrate, or recalibrate, the control circuitry 100 after insertion into the downhole device 10.

Indeed, the assembled cartridge 95 may be releasably engaged within a pressure test setup, or a test rig, in order to pressure test the elements of the cartridge 95 prior to use in the downhole environment. In particular, it is possible to test that there is a correct pressure connection between the transducer 130 and the transducer adaptor 135 prior to use in the final downhole device 10. This is particularly beneficial as the establishment of a pressure connection is a time-consuming process.

The assembled cartridge 95 may be releasably engaged with the pressure test setup by engaging a test end cap, which will have corresponding attachment means to the transducer sub-module 40 of the downhole device 10. The pressure test end cap may be configured to form a pressure pathway between the entry port of the transducer 130 of the assembled cartridge 95 to the pressure environment of the test setup. It is then possible to perform a pressure test to determine whether a correction pressure connection between the transducer 130 and the transducer adaptor 135 has been established.

It is then possible calibrate the pressure tested cartridge 95, which comprises the transducer 130, the transducer 135 and the control circuitry 100 mounted to the chassis 90. For the calibration process to be performed, the control circuitry may require only the first microprocessor 110, the second microprocessor 120 and the memory unit 140.

The pressure tested cartridge 95 may be placed into an environment with a known or controllable pressure and additionally or alternatively temperature in order to calibrate the control circuitry 100 to the temperature and/or pressure data taken by the transducer 130.

To perform calibration of the control circuitry 100, the raw measurements of at least one of pressure and temperature are obtained from the transducer 130. In this arrangement, control circuitry 100 may be configured to connect to an external computing device, such as a PC running software. In this arrangement, the raw readings of at least one of pressure and temperature will be transmitted to the first microprocessor 100 via an analogue-to-digital converter. The raw data may be configured to be transmitted to the external computing device via the memory unit 140 and communication signals in the electrical connector 35.

The software operating on the external computing device may be configured to receive the raw readings of at least one of pressure and temperature and to convert the raw data into meaningful information. In some embodiments, the software operating on the external computing device may be configured to convert the pressure and temperature readings into engineering values such as temperature as degrees Celsius and pressure as psia. In this arrangement, it is then possible to determine how the first microprocessor 110 may be calibrated to interpret the measurements taken from the transducer 130. The first microprocessor 110, may then be programmed with firmware that is configured to contain calculations for calibration. The transducer 130 may then be calibrated such that the data received by the first microprocessor 110 may be processed accurately In some embodiments, the accelerometer 190 does not require calibration. In these arrangements, the output from the accelerometer 190 may be transmitted to the second microprocessor 120 where the acceleration data may be converted into standard units ($m/s^2$ or g) without the need for calibration. In some embodiments, it may be possible to calibrate the second microprocessor 120 to the accelerometer 190 using a corresponding mechanism as for the transducer 130 and the first microprocessor 110.

Having completed the calibration process, the control circuitry 100 may then be calibrated to the specific accelerometer 190 and transducer 130. It is therefore possible to disassemble the calibration setup so that the cartridge 95 is calibrated to the particular accelerometer and transducer 130 that is attached to it. Furthermore, the seal formed between the transducer 130 and the transducer adaptor 135 has also undertaken a pressure test. As a result, the assembled cartridge 95, comprising mounted control circuitry 100, the transducer 130 and the transducer adaptor 135 may be ready for insertion into a downhole device 10.

As a result of the calibration process, the single chassis member 90 that supports some or all of the control circuitry 100 as well as the transducer 130 and transducer adaptor 135 can be sent to the site of the downhole bore for insertion into a downhole device 10. After use of the downhole device 10, the elements of the cartridge 95, including the control circuitry 100, the accelerometer 190 and the transducer 130 may require re-calibration. It is therefore possible to releasably remove the cartridge 95 from inside the housing 25 of the main module 20 and return the cartridge 95, including the elements mounted on the chassis 90 that require re-calibration to a suitable environment for calibration.

It is then possible to insert a newly pressure tested and calibrated cartridge 95, supporting some or all of the elements of the chassis 90 into the downhole device 10. The downhole device 10 can then be re-assembled and is ready for use. Advantageously, the pressure connection between the entry port of the transducer 130 and the transducer adaptor 135 is already established. In some embodiments, it may then only be necessary to insert the newly calibrated cartridge 95 into the main module 20 and releasably engage the cartridge 95 to the transducer sub-module 40. As a result, it is only necessary to perform a short in-the-field pressure test of the pressure pathway from the transducer adaptor 135 to the pressure port 170 of the transducer sub-module 40. In some embodiments this pressure test may take less than 15 minutes, which may save a significant amount of operational time in the setup process of the downhole device 10 at the use location.

Assembly and Disassembly of Downhole Device

Having used the downhole device 10 to control or activate a downhole tool, the downhole device 10 may then be removed from the downhole environment. As described previously, some components of the main module 20 may require re-calibration after operation of the downhole device 10. As a result, it is beneficial to downhole devices to be able to easily disassemble and reassemble the downhole device 10, in particular the main module 20 of the downhole device 10.

An exemplary assembly and disassembly process is outlined below for some embodiments.

In some embodiments, the control circuitry 100 and the electrical connector 35 are mounted to the chassis 90. In the manner described earlier and shown in further detail in FIGS. 6(*a*) to 6(*c*), the transducer 130 may be releasably engaged with the transducer adaptor 135. This releasable engagement may be at a specified torque. The transducer 130 and the transducer adaptor 135 are then releasably engaged with the chassis 90. The transducer adaptor 135 and the chassis 90 comprise cooperatively formed threaded holes through which grub screws are releasably engaged so as to further secure the transducer 135 to the chassis 90. The assembled components may then form part or all of the assembled cartridge 95.

The electrical cabling 47 attached to the transducer 130 may then be electrically connected to the control circuitry 110. In some embodiments, the electrical connection may be formed by direct soldering or, in other embodiments, by releasable engagement by an electrical connector.

The assembled cartridge 95 may be pressure tested and calibrated before assembly of the main module 20. The assembled and calibrated cartridge 95 is then releasably engaged with the transducer sub 40 at a particular torque. In some embodiments, the releasable engagement of the transducer sub-module 40 and the transducer 135 may be formed by a threaded portion on each element, as shown in FIGS. 6(*a*)-6(*c*). As shown in FIGS. 6(*a*)-(*c*), the transducer adaptor 135 may be formed with a flat slot, or notched portion, to enable the user to engage the transducer 135 and the transducer sub-module 40 at a particular torque.

It is then possible to pressure test the assembled cartridge 95 and the transducer sub-module 40 to ensure that the releasable engagement of the transducer sub-module 40 and the transducer adaptor 135 form a correct pressure pathway from the pressure port 170. Having established a correct pressure connection, the cartridge 95 and transducer sub-module 40 may then be slidably and co-operatively inserted into the housing 25 of the main module 20.

In some embodiments, the transducer sub-module 40 may then be releasably engageable with housing 25 at portion 45 of the transducer sub-module 40. The engagement of the housing 25 and the transducer sub-module 40 forms a seal to isolate the internal components of the main module 20 from the external environment. In some embodiments, the transducer sub-module 40 may be engaged with the housing 25 at a particular torque.

After the downhole operation using the downhole device 10 has been completed, the downhole device 10 may be removed from the downhole environment and disassembled in the reverse manner to the assembly process. It is then possible to use a newly pressure tested and calibrated cartridge 95 for re-assembly of the downhole device 10 as described above, so that the downhole device 10 is ready for use.

Connection of the Main Module and the Battery Module

Figure 7:
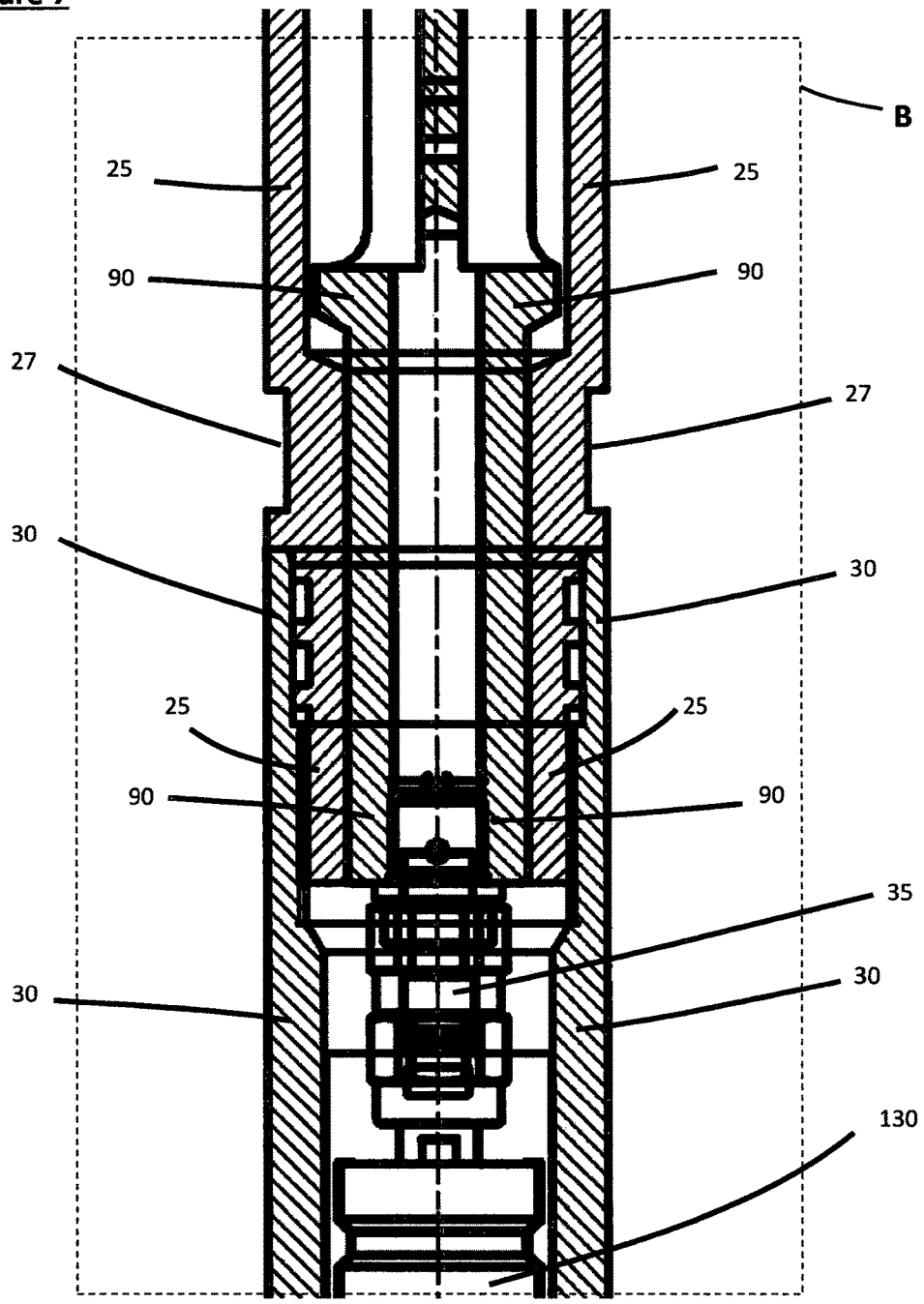
FIG. 7 shows an enlarged side view of the highlighted portion B of the downhole device of FIGS. 1 to 6.

FIG. 7 shows a side view of the releasable connection between the main module 20 and the battery module 30. As described previously, the main module 20 and the battery module 30 may be configured so that the releasable engagement forms an environmental seal. As shown in FIG. 7, the end of the housing 25 of the main module 20 that is opposite the transducer sub-module 40 comprises a threaded portion which may be inserted into the housing of the battery module 30.

The mechanical engagement of the housing 25 and the battery module 30 may be made by inserting and rotating the housing 25 with respect to the battery module 30 to engage the threaded portions. In some embodiments, the threaded engagement of the main module 20 and the battery module 30 may be at a pre-specified torque. In some embodiments, including the embodiment of FIG. 7, the housing 25 of the main module 20 may comprise a notched portion 27 around the circumference of the housing 25 which may be configured to receive a tightening tool, such as a torque wrench, in order to aid the engagement of the main module 20 and the battery module 30 to make the electrical connection.

Communication of the Elements of the First Embodiment

Figure 8:
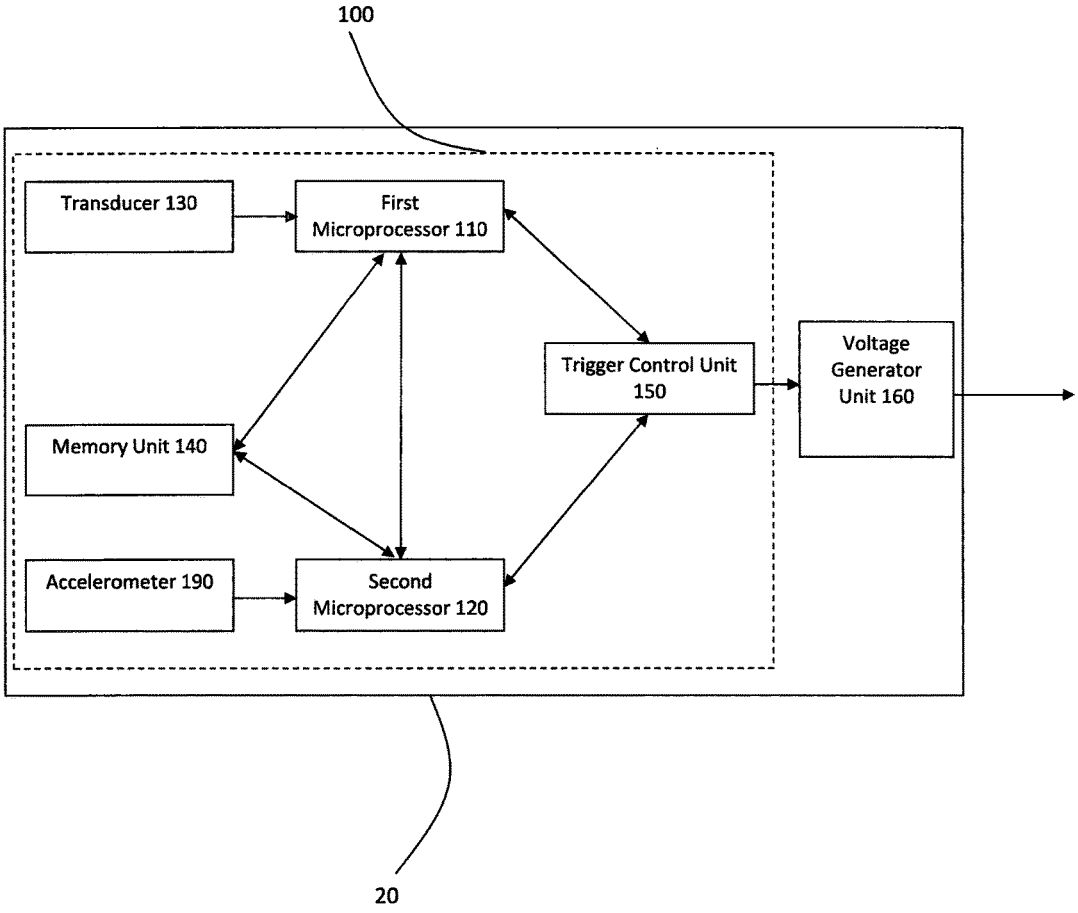
FIG. 8 shows the communication between the elements of the downhole device of FIGS. 1 to 7.

The elements of the control circuitry 100 and how the elements interact in the first embodiment are shown in FIG. 8.

The memory unit 140 of the control circuitry 100 may comprise digital storage, such as digital memory chips, for example flash memory integrated circuits. The memory unit 140 may be configured to store data received from other elements of the control circuitry 100 and to enable the programming of the first 110 and the second 120 microprocessors. In some embodiments, the memory unit 140 may be used as a data logger to stored data received from other elements of the control circuitry 100 or from the transducer 130 and the accelerometer 190. In other embodiments, the memory unit 140 may be used as additional memory for the function of the control circuitry 100, such as Random Access Memory (RAM) for the first 110 and the second 120 microprocessors.

The first microprocessor 110 of the control circuitry 100 may be configured to communicate with other elements of the control circuitry 100. In particular, in some embodiments the first microprocessor 110 is configured to receive at least one of temperature and pressure measurements from the transducer 130. The first microprocessor 110 may receive data from the transducer 130 which is indicative of the measured temperature and/or pressure of the external environment. The first microprocessor 110 may be configured to process the temperature and/or pressure measurements to progress a control sequence, as described later. The first microprocessor 110 may also be configured to communicate electronically with other elements of the control circuitry 100, including the second microprocessor 120, the memory unit 140 and a trigger control unit 150.

The second microprocessor 120 of the control circuitry 100 may also be configured to communicate with other elements of the control circuitry 100. The second microprocessor 120 may be configured to receive signals from an accelerometer 190 which are representative of acceleration measurements made by the accelerometer 190. The second microprocessor 120 may be configured to process the acceleration data to progress the control sequence, as described later. The second microprocessor 120 may also be configured to communicate electronically with other elements of the control circuitry, including the first microprocessor 110, the memory unit 140 and the trigger control unit 150.

In other embodiments, the first microprocessor 110 and the second microprocessor 120 may be implemented using implementations including, but not limited to, an Application Specific Integrated Circuit (ASIC), a Field Programmable Gate Array (FPGA) using a Hardware Description Language, a dedicated microprocessor or a Programmable Logic Device (PLD). The term microprocessor is intended merely to represent the functionality of the first 110 and the second 120 processors and should be limited as such.

In some embodiments, the first and second microprocessors 110, 120 may be configurable to be programmable via programming signals external to the downhole device 10. Further, in some embodiments the first and second microprocessors 110, 120 may be configurable to receive updated parameters which affect the operation of the microprocessors. In some embodiments, the programming of the microprocessors may be performed prior to assembly as part of the calibration process. In some embodiments, the first 110 and second 120 microprocessors may be programmable through communication pins in the connector 35 at an end of the main module 20, as described later.

The accelerometer 190 of the control circuitry 100 may be configured to convert measured acceleration of the downhole device 10 into signals which are representative of acceleration data. In some embodiments the accelerometer 190 is a bi-axial accelerometer and in other embodiments the accelerometer 190 is a tri-axial accelerometer. In some embodiments, the accelerometer 190 may be a MEMs accelerometer. In some embodiments, the accelerometer 190 may be piezoelectric, piezoresistive or capacitive. Further, in other embodiments the accelerometer 190 may be board-mounted to a PCB of the control circuitry 100. It will be appreciated that the person skilled in the art can choose any type of accelerometer or combination of accelerometers known at the time of filing the application suitable for use in downhole devices.

The trigger control unit 150 of the control circuitry 100 may be configured to electronically communicate with the first microprocessor 110 and the second microprocessor 120. The trigger control unit 150 may also be configured to generate a trigger signal in response to appropriate signalling from the first 110 and second 120 microprocessor. In some embodiments, the trigger signal generated by the trigger control unit 150 may be a low-voltage control signal 210 of a specified frequency, such as a fixed frequency square-wave signal. In some embodiments, the frequency of the low-voltage control signal 210 may be selected and/or configured to the particular voltage generator module 160 that is used so that the low-voltage control signal 210 activates the voltage generator unit 160. In other embodiments, the frequency of the low-voltage control signal 210 may be software-controlled.

The control circuitry 100 may be configurable to electronically communicate the low-voltage trigger signal 210 to the voltage generator unit 160. The voltage generator unit 160 may be configurable to generate an appropriate high voltage control signal 200 in response to the low voltage control signal 210 from the trigger control unit 150 of the control circuitry 100.

The control circuitry 100 may further comprise a buzzer which is in electronic communication to either or both of the first microprocessor 110 and the second microprocessor 120. The buzzer may be configured to provide a sound in response to an appropriate control signal from either or both of the first 110 and the second 120 microprocessor. The buzzer may sound to indicate to the user a pre-defined state of the control sequence of the control circuitry 100.

The trigger control unit 150 may be configured to be in communication with both the first 110 and the second 120 microprocessor. The trigger control unit 150 may be configured to generate the low voltage control signal 210 in response to control signals from both first and second microprocessor. When a control signal from both microprocessors is received the trigger control unit can then generate the low voltage control signal 210. Preferably, the first microprocessor 110 and the second microprocessor 120 will need to agree that the control sequence of each microprocessor has successfully been completed before the trigger control unit 150 will generate the low voltage control signal 210.

This is particularly beneficial in arrangements where the downhole tool to be controlled is a detonator 70 as the control signal is preferably only activated when both the first 110 and second 120 microprocessors confirm that the signal should be generated.

The first microprocessor 110 may be configured to only send a control signal to the trigger control unit when the data received from the transducer 130 meets the requirements of the control sequence, described later. Similarly, the second microprocessor 120 may be programmed to only send a control signal to the trigger control unit 150 when the data received from the accelerometer 190 meets the requirements of the control sequence. Therefore, the control circuitry 100 assesses the acceleration of the downhole device 10 and one or more of pressure and temperature of the environment external to the downhole device 10 before generating the low voltage control signal 210.

This feature prevents the low voltage control signal 210 from being transmitted in environments or positions that are not intended by the use of the downhole device, such as on the surface or near the user.

It will be appreciated that electronic communication is merely used as an exemplary communication method. In other embodiments, it will be appreciated that other communication methods may be employed, such as optical communication.

Control Signal of the First Embodiment

Figure 9:
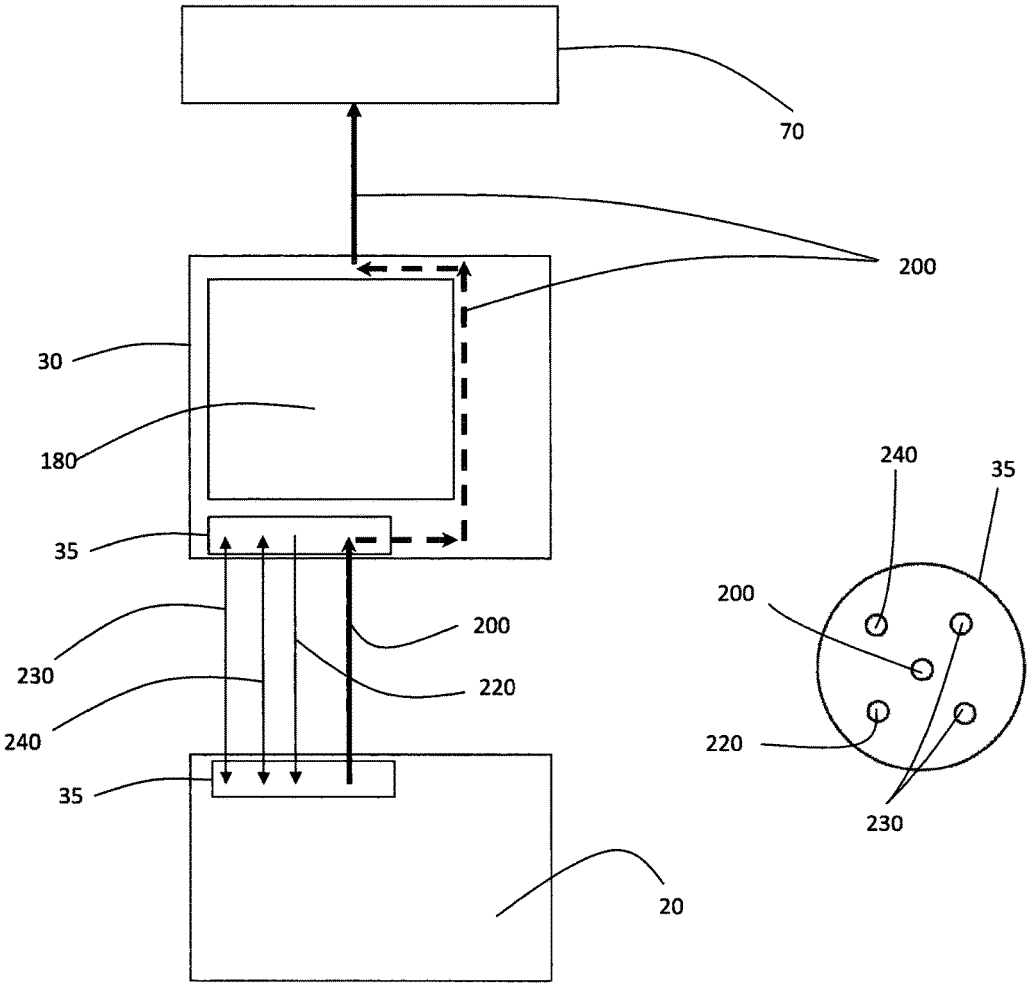
FIG. 9 shows the routing of the trigger signal through the elements of the downhole device of FIGS. 1 to 8.

FIG. 9 shows an exemplary configuration of the electrical signals that are passed between the main module 20 and the battery module 30 through the electrical connector 35. In the embodiment of FIG. 9, the connector used is a LEMO™ connector that comprises five pins configured to carry electrical signals.

In the embodiment of FIG. 9, the low voltage control signal 210 generated by the control circuitry 100 is an electrical signal which is configured to control a downhole tool. In the embodiment of FIG. 9, the downhole tool is a detonator 70, such as a perforating gun.

In the embodiment of FIG. 9, the low voltage control signal 210 generated by the control circuitry 100 may be transmitted to the voltage generator unit 160 within the main module 20. The voltage generator unit 160 may be configured to convert the low voltage control signal 210 into a higher voltage control signal 200. In the embodiment of FIG. 9, the higher voltage control signal 200 generated by the voltage generator unit 160 may be configured to signal a detonator 70 to activate.

The routing of the high voltage control signal 200 through the downhole device 10 is shown schematically in FIG. 9. The high voltage control signal 200 may be transmitted through a pin of the connector 35. The high voltage control signal 200 may be routed through the battery module 30 as shown in FIG. 9 external to the battery unit 180. The high voltage control signal 200 may then be transmitted from the output pin 185 at the other end of the battery module 30 from the main module 20 and though the remainder of the elements of the downhole device 10 to the detonator 70.

In the embodiment of FIG. 9, the electrical connection between the main module 20 and the battery module 30 comprises a total of five electrical pins. Two of the five pins 230 of the connector between the main module 20 and the battery module 30 are configured to enable two-way communication in the form of a receive, Rx, and a transmit, Tx, signal 230. It will be appreciated by the person skilled in the art that the battery module may comprise a different number of electrical pins and/or optionally a different arrangement of the electrical pins.

In some embodiments, the communication signals Rx and Tx may be used to program the control circuitry 100 of the main module 20 prior to connection with the battery module 30. In some embodiments, the communications signals 230 may be used for operation in the downhole device 10, for example to communicate with elements housed in other modules of the downhole device 10.

Pins 220, 240 of the connector 35 carry the battery voltage $V_b$ and the electrical ground, GND, so that electrical power can be provided to the main module 20. In some embodiments, including the embodiment of FIG. 9, the electrical power generated by the battery unit 180 may be used to electrically power the control circuitry 100, the transducer 130, the accelerometer 190 and the voltage generator unit 160. In some embodiments, any additional electrical units or modules may also be powered by the electrical power generated by the battery unit 180.

In some embodiments, the connectivity between the battery module 30 and the main module 20 may comprise additional pins and signals. Indeed, in some embodiments, communication methods or protocols, such as Controller Area Network (CAN), PCI-E or USB, that utilise different pin configurations may be used. It is well within the capability of the skilled person to replace the electrical connector 35 shown in the embodiment of FIG. 9 with a different connection that comprises further pins and/or signals.

The connector 35 that provides an electrical connection between the main module 20 and the battery module 30 is sufficiently rated to handle the electrical current generated by the various signals.

As shown, the electrical connector 35 that connects the main module 20 and the battery module 30 may be configured to handle signal communications to and from the main module 20, such as Tx and Rx signals that may be used to program the control circuitry 100 of the main module 20. The electrical connector 35 may also be configured to, at the same, handle the control signal connection that can be passed through the conduit defined in the battery module 30 and also the electrical power connections, $V_b$ and GND, which are connected directly to the battery unit 180. Advantageously, all of these connections can be handled through a single physical connector. This means that it is not necessary to use multiple connectors or separate the signal and power connections.

Schematic Layout of the Elements of the Second Embodiment

Figure 10:
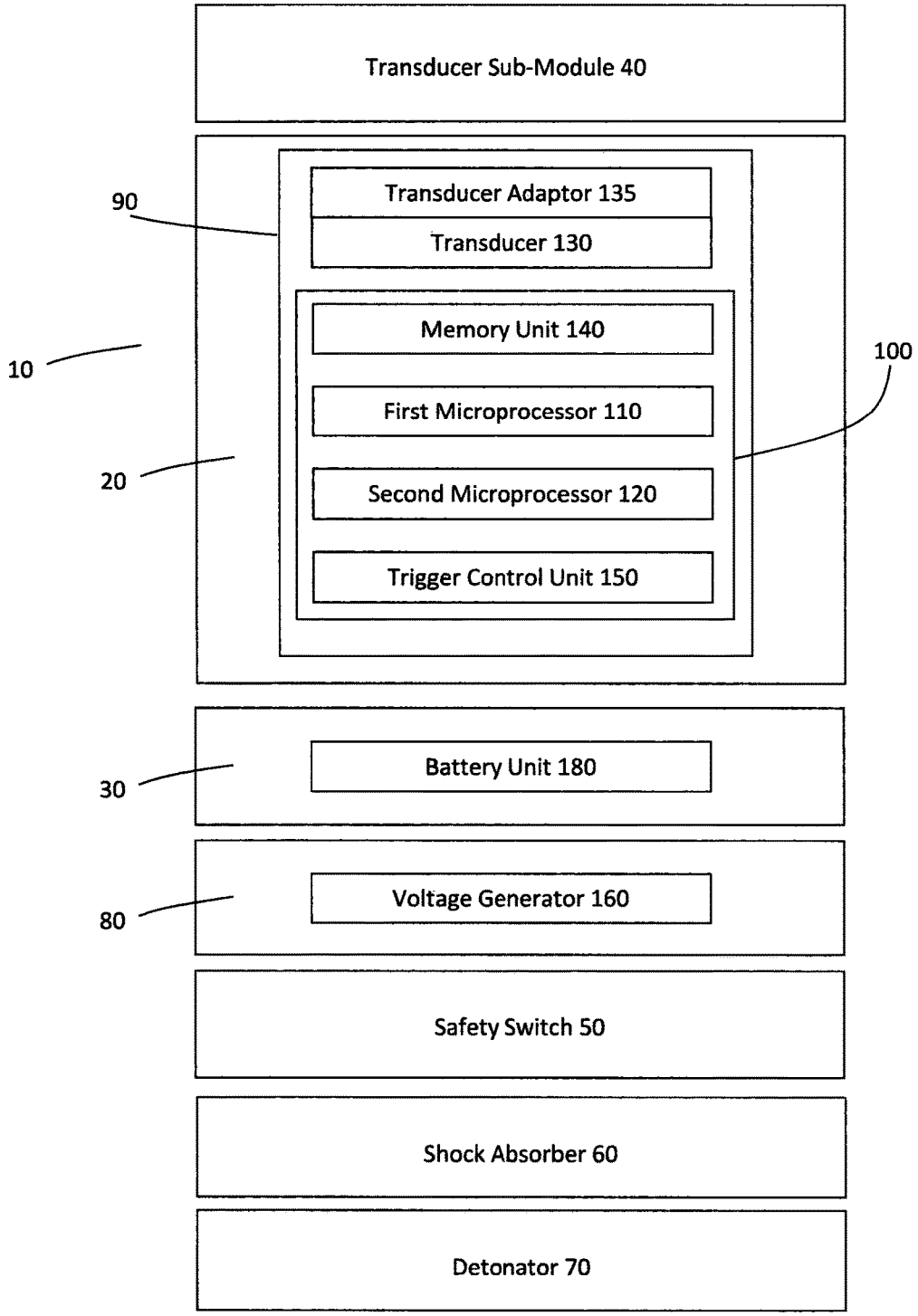
FIG. 10 shows a schematic layout of the downhole device of a second embodiment of the present invention.

FIG. 10 shows the schematic layout of the components of a second embodiment. In the second embodiment, the voltage generator unit 160 is not housed within the housing 25 of the main module 20 and is not mounted to the chassis 90 of the main module 20. In contrast, the voltage generator unit 160 is housed within a third module, a voltage generator module 80 which is a separate from the main module 20.

In some embodiments, including the embodiment of FIG. 10, the layout of the remainder of the elements of the downhole device 10 may be the same as for the first embodiment of FIG. 1. In particular, the chassis 90 of the downhole device 10 may be the same chassis element as used for the first embodiment of FIG. 1. However, in other embodiments, the chassis 90 of the first embodiment may be a different shape or configuration to the chassis 90 of the second embodiment. The voltage generator unit 160 of the first embodiment may be mounted to the chassis 90. Conversely, the voltage generator 160 may be housed in a separate module located externally to the main module 20 and so the chassis 90 of the second embodiment is not required to support the voltage generator 160.

The other significant difference to the physical layout of the elements of the downhole device 10 between the first embodiment and the second embodiment of FIG. 10 is that the control signal output from the main module 20 through the connector 35 is not the high voltage control signal 200 generated by the voltage generator unit 160. In contrast, the control signal output from the main module 20 is the low voltage control signal 210 generated by the control circuitry 100.

By providing a physically separated and modular voltage generator unit 160, it is then possible for the user to select the appropriate voltage generation for a particular use or apparatus without opening the pressure-sealed main module 20. The voltage generator module 80 may be releasably engageable with the output pin 185 of the battery module 30 and thus can simply be replaced with a suitable voltage generator module 80 for a particular application.

Figure 12:
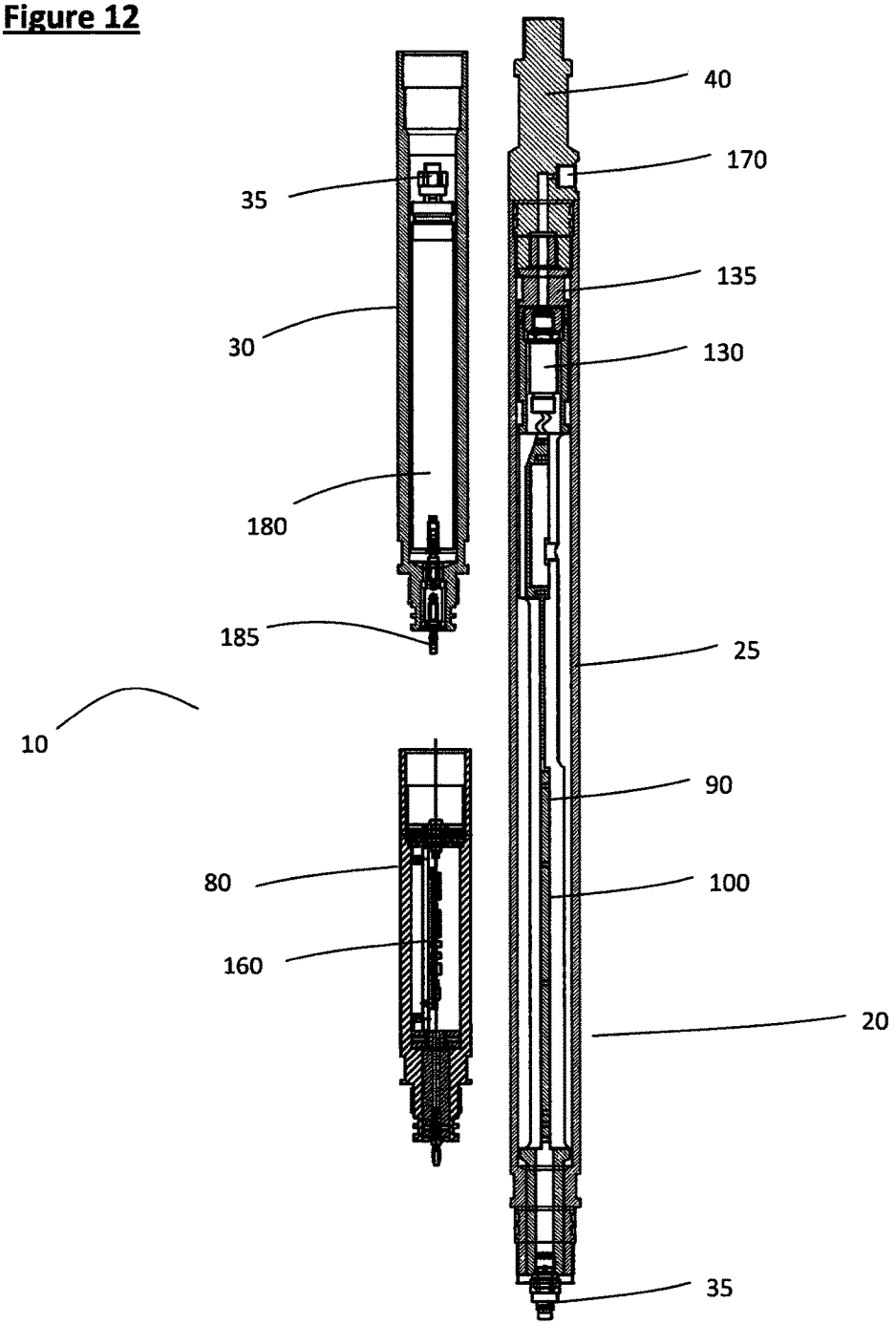
FIG. 12 shows a side view of the downhole device of FIGS. 10 and 11.

The arrangement of the modules of the embodiment of FIG. 10 is shown in more detail in FIG. 12. The downhole device 10 of FIG. 12 may comprise three modules, the main module 20, the battery module 30 and the voltage generator module 80. In some embodiments, including the embodiment of FIG. 12, the remaining elements of the main module 20 may be the same as used in the first embodiment of FIG. 1.

The voltage generator module 80 comprises a chassis element that is slidably removable from the housing of the voltage generator module 80, in substantially the same way as the chassis 90 of the main module 20. The voltage generator unit 160 may be mounted to the chassis of the third module 80. The voltage generator module 80 may be configured with an output pin at one end which is configured to directly correspond in physical arrangement with the output pin 185 of the voltage generator unit 80.

By providing identical or similar output pins for the battery module 30 and the voltage generator module 80, it may be possible to easily change the arrangement of the first embodiment to the second embodiment, by replacing the chassis 90 of the main module 20 for a different chassis without a voltage generator unit 160 and by releasably engaging the voltage generator module 80 to the output pin 185 of the battery module 30, as indicated in FIG. 12.

In some embodiments, including the embodiment of FIG. 10, it may be possible to use some of the same modules regardless of the arrangement of the main module 20. As shown in the embodiment of FIG. 10, the safety switch 50, the shock absorber 60 and the detonator 70 that may be attached to the voltage generator module 80 may be the same as for the downhole device 10 according to the first embodiment of FIG. 1. For example, in the arrangement of FIG. 10, the voltage generator module 80 is configured to generate the high voltage control signal 200 and transmit that signal to the safety switch 50. As the output pins of the battery module 30 and the voltage generator module 80 are the physically the same, it may be possible to attach both the battery module 30 and the voltage generator module 80 to the same safety switch 50.

Therefore, it is not necessary to provide any adaption or additional connectivity for the safety switch 50, the shock absorber 60 and the detonator 70 when changing between the first embodiment of FIG. 1 and the second embodiment of FIG. 10 of the present invention.

As shown in FIG. 12, the end of the voltage generator module 80 that is opposite the output pin may comprise an electrical connector and a threaded portion configured to receive the battery module 30 in releasable engagement to ensure electrical connection between the battery module 30 and the voltage generator module 80. The engagement of the battery module 30 and the voltage generator module 80 additionally forms an environmental seal to protect the voltage generator unit 160 and the chassis of the voltage generator module 80 from the external environment, such as the downhole environment. In addition, the releasable engagement between the output pin of the voltage generator module 80 and the safety switch 50 may form a seal to substantially isolate the internal elements of the voltage generator module 80 from the downhole environment.

As the internal elements of the voltage generator module 80 are substantially isolated from the external downhole environment in use, it may not be necessary to manufacture them from materials graded for high pressure and/or temperature. Therefore, in some embodiments the chassis of the voltage generator module 80 may be made from a lightweight, robust material such as aluminium.

Meanwhile, the external housing of the voltage generator module 80 may be required to maintain its integrity in the downhole environment. In some embodiments, the voltage generator module 80 may be configured to withstand pressures in excess of 30,000 psi. In these embodiments, the housing of the voltage generator module 80 may be formed of Monel, Inconel or an equivalent material. In other embodiments, the voltage generator module 80 may be configured to withstand pressures exceeding 15,000 psi and exceeding 30,000. In these embodiments, the housing of the voltage generator module 80 may be formed of Monel or an equivalently graded Stainless Steel such as 17-45S.

In some embodiments, including the embodiment of FIG. 12, the connector 35 between the main module 20 and the battery module 30 may be the same physical connector as is used in the first embodiment of FIG. 1. The five connection pins provided for in the first embodiment of FIG. 1 may be the same as in the second embodiment of FIG. 10. However, instead of routing the high voltage control signal 200 through the connector 35 between the main module 20 and the battery module 30, the low voltage signal 210 may be transmitted through the connector 35. Therefore, it may be that only the internal wiring of the main module 20 which differs between the first and second embodiment and the internal wiring of the battery module 30 remains the same.

In some embodiments, including the embodiment of FIG. 12, the low voltage signal 210 may be routed through the conduit formed between the housing of the battery module 30 and the battery unit 180. As the physical connections through the battery module 30 may not differ between the first and second embodiments, it may be possible to use the same battery module 30 for the first embodiment of FIG. 1 and the second embodiment of FIG. 10. However, the signal wires that are routed through the conduit defined in the battery module 30 should be rated for the current provided by both the low voltage 210 and high voltage 200 control signals.

Communication of the Elements of the Second Embodiment

Figure 11:
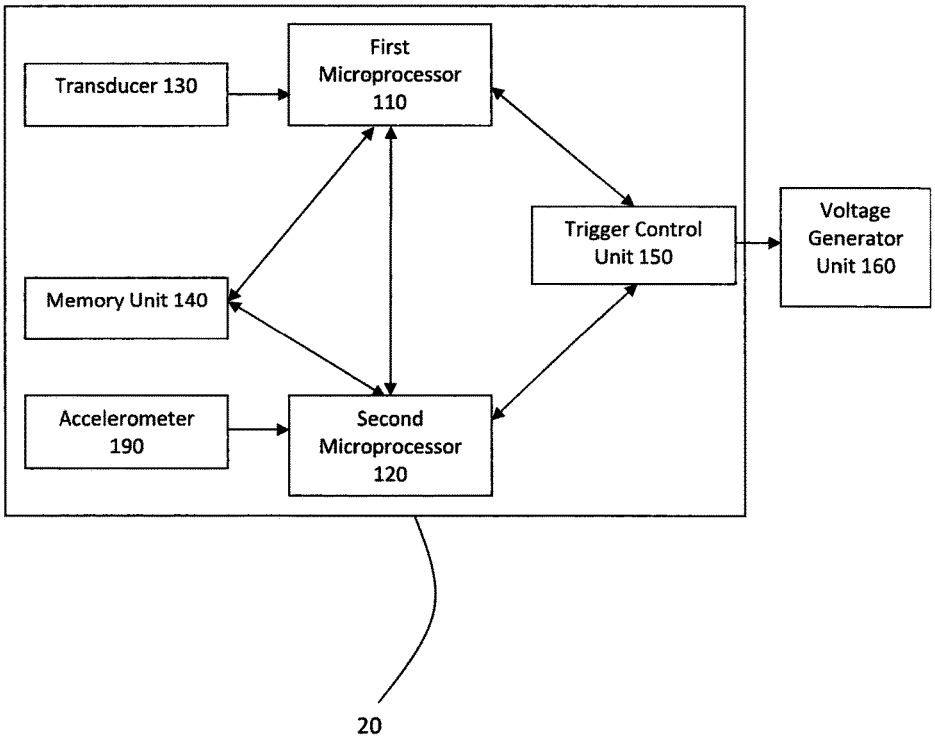
FIG. 11 shows the communication between the elements of the downhole device of FIG. 10.

In the embodiment of FIG. 11, the communication of the elements of the main module 20 is substantially similar to the communication of the elements of the main module 20 in the first embodiment of FIG. 1. However, as discussed previously, the main module 20 of the second embodiment of FIG. 10 does not generate a high voltage control signal 200. Indeed, as shown in FIG. 11, the output signal from the main module 20 is the low voltage control signal 210 output from the trigger control unit 150 of the control circuitry 100.

The low voltage control signal 210 may be transmitted to the voltage generator unit 160, which is external to the main module 20, through the battery module 30. The voltage generator unit 160 then converts the low voltage control signal 210 from the main module 20 into a high voltage signal that is suitable to control a downhole tool. In the second embodiment of FIG. 10, the voltage signal generated by the voltage generator unit 160 may be used to trigger the activation of a detonator 70, for example for a perforating gun.

It will be appreciated that the high-voltage control signal 200 generated by the external voltage generator unit 160 housed within the voltage generator module 80 can be used for a variety of different applications. Indeed, in some embodiments the voltage generator unit 160 may trigger the activation of logging and downhole measurement. The specific voltage and nature of the high-voltage control signal 200 will depend upon the application.

Control Signal Routing of the Second Embodiment

Figure 13:
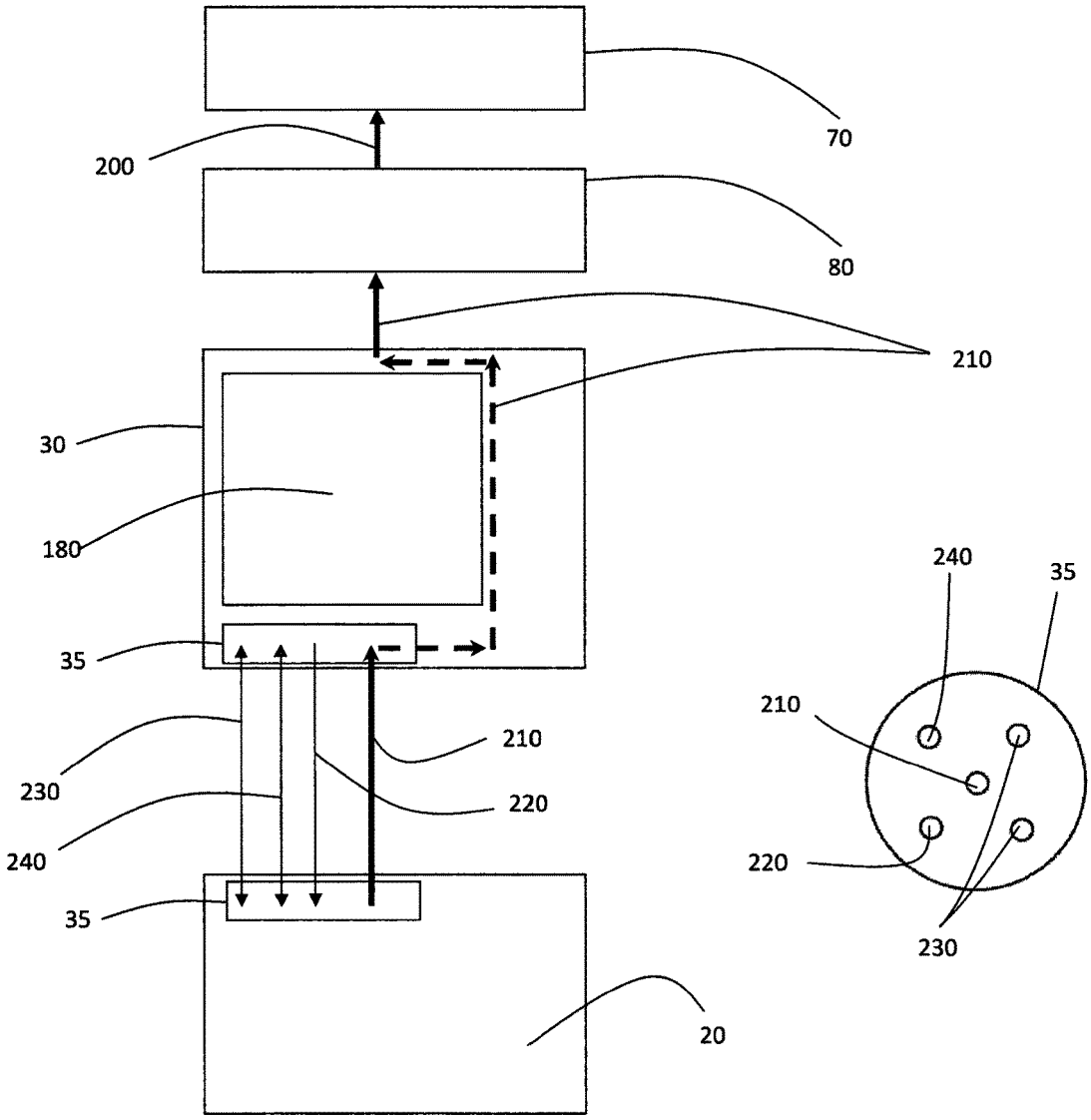
FIG. 13 shows the routing of the trigger signal through the downhole device of FIGS. 10 to 12.

FIG. 13 shows the routing of the control signal through the downhole device 10 of the second embodiment of FIG. 10.

As discussed above, in the embodiment of FIG. 10, the voltage generator unit 160 is not housed within the main module 20. In contrast, the voltage generator unit 160 may be housed within a separate module, the voltage generator module 80. In this arrangement, the control signal output from the main module 20 is the low voltage control signal 210 generated by the trigger control unit 150.

As shown in FIG. 13, the low voltage control signal 210 may be routed through the connector 35 from the main module 20 to the battery module 30. The low voltage control signal 210 may pass through the conduit defined between the battery unit 180 and the housing of the battery module 30. The physical routing of the low voltage control signal 210 may be the same physical routing as for the high voltage control signal 200 of the first embodiment of FIG. 1. Beneficially, the same battery module 30 may be used in both the first embodiment of FIG. 1 and the second embodiment of FIG. 10.

The low voltage control signal 210 may then output through the output pin 185 of the battery module 30 and may be transmitted into the voltage generator module 80 to the voltage generator unit 160. The voltage generator unit 160 may then converts the low voltage control signal 210 into the high voltage control signal 200. The high voltage control signal 200 may then be transmitted from the output pin of the voltage generator module 80 and through the remaining elements of the downhole device 10 to the downhole tool. In the embodiment of FIG. 13, the downhole tool is a detonator 70 and the high voltage control signal 200 generated by the voltage generator 180 is configured to activate or control the detonator 70.

Operation of the Device

As described earlier, the control circuitry 100 executes a control sequence in order to generate the low voltage signal 210. The exact sequence may be determined by the firmware programmed into the control circuitry 100, in particular the first 110 and second 120 microprocessors.

As discussed previously, in some embodiments, the trigger control unit 150 may not generate the low voltage control signal 210 unless it receives a signal from both of the first 110 and the second 120 microprocessors. In some embodiments, the first microprocessor 110 receives at least one of temperature and pressure data from the transducer 130 in order to generate the signal that is transmitted to the trigger control unit 150. The second microprocessor 120 may receive data from the accelerometer 190 in order to generate the signal that is transmitted to the trigger control unit 150. When the trigger control unit 150 has received both signals, it can generate the low voltage control signal 210.

In some embodiments of the present invention, each microprocessor 110, 120 steps through a series of phases to indicate progression through a sequence before the signal to the trigger control unit 150 is generated. This phased control sequence reduces the risk of the low voltage control signal 210 from being generated erroneously.

The control sequences processed by the first 110 and second 120 microprocessors may take into consideration upper and lower fail safe pressures, temperatures and accelerations and may further take into consideration time delays, from seconds to days in order progress the phased control sequences. It will be appreciated that any number of different phased sequences can be used, depending upon the particular application.

Figure 14:
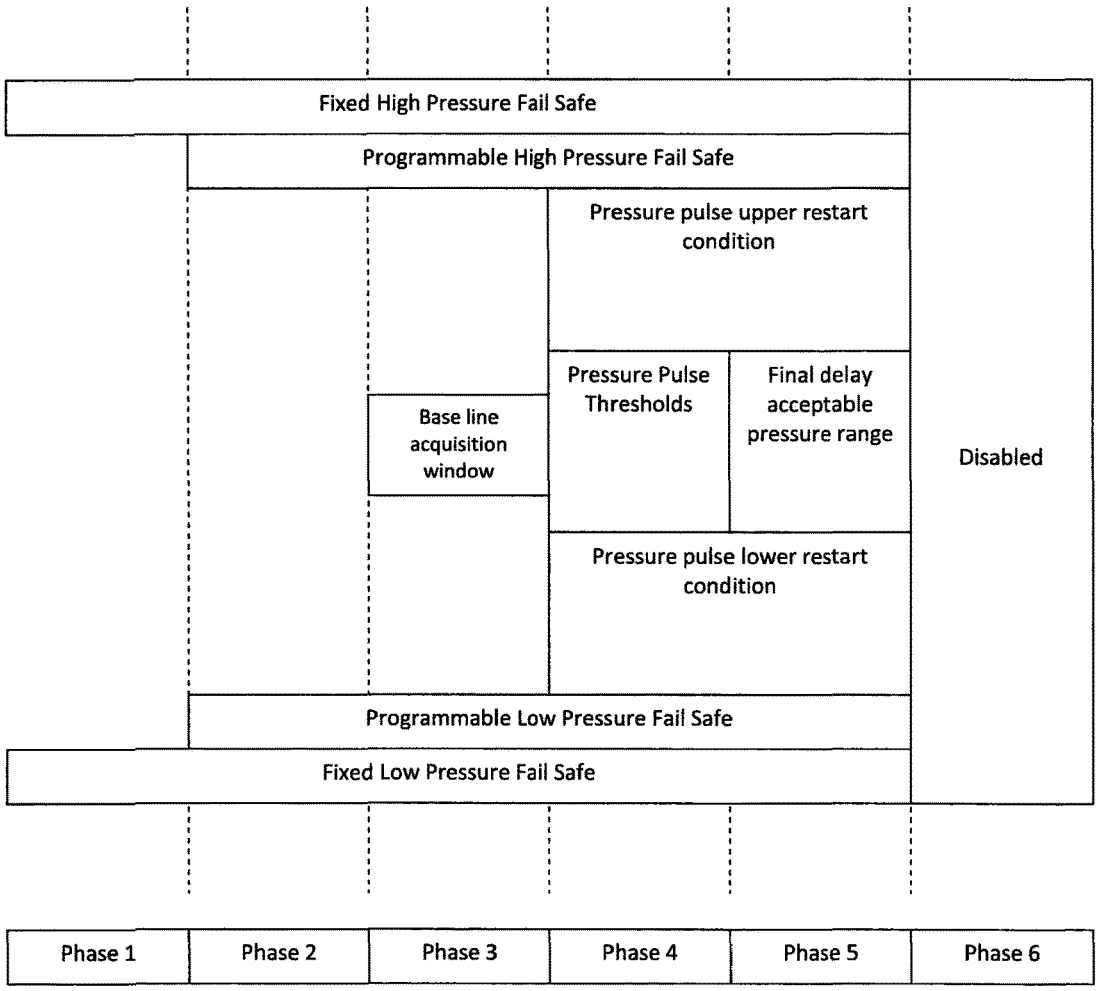
FIG. 14 shows the pressure thresholds for the control sequence of the downhole device of FIGS. 10 to 13.

An exemplary phased control sequence is shown in FIG. 14 in a particular embodiment, for a first microprocessor 110 in communication with a transducer 130 configured to generate a control signal to the trigger control unit 150. In phase 1 of the exemplary phased control sequence, the first microprocessor checks whether an upper and lower limit of fixed pressure has been exceeded within a specified time limit. In other embodiments, the fixed upper and lower limit may be checked throughout the control sequence.

If the measured pressure is between the fixed fail safe pressure, the first microprocessor 110 will proceed to phase 2. In some embodiments, if the measured pressure is less than the fixed low pressure fail safe or higher than the fixed high pressure fail safe, then the operation of the downhole device 10 may be disabled. In other embodiments, the sequence may be reset. In some embodiments, the fixed pressure thresholds may be hard-coded into the first microprocessor 110. In some embodiments, the hard-coded high and low pressure thresholds may be defined to be 200 psi<pressure<20,000 psi. In some embodiments, similar functionality may be defined for corresponding temperature data. In some embodiments, the hard-coded high and low temperature thresholds may be defined as 5° C.<temp<200° C.

Phase 2 of the phased control sequence introduces a further fail safe threshold, which narrows the operating window further. The measured pressure data must be in the programmable high pressure and low pressure fail safe thresholds, shown in FIG. 14, for a software-defined period of time to progress to phase 3 of the phased control sequence. The values for programmable low pressure and high pressure fail safe thresholds may be firmware defined and configured. If the measured pressure from the transducer 130 deviates above the upper threshold or below the lower threshold of defined pressure thresholds then the sequence may be reset or alternatively the downhole device 10 may be disabled.

In the exemplary control sequence of FIG. 14, a baseline pressure may be established in software during phase 3 of the sequence. The user preferably determines the target baseline pressure which is defined by the depth and well fluid. The pressure preferably remains within the specified band for a minimum period of time, where the average pressure measured during that period of time by the transducer 130 is assigned as the baseline pressure.

Deviations from the baseline pressure may be determined to be pulses of pressure. The first microprocessor 110 may be software configurable to monitor for a particular sequence of pressure pulses in order to progress to phase 4 of the sequence. Any pressure pulse which does not stay within the operating window defined by the pressure pulse upper restart and lower restart thresholds may reset the pulse monitoring sequence, i.e. the sequence will return to the beginning of phase 4 of the sequence.

Once all specified pressure pulses are recognised, the sequence will progress to phase 5. In phase 5, the sequence waits for a further time delay to elapse, while the pressure stays within the programmed and hard-coded pressure windows defined by the upper and lower thresholds. After the defined time delay elapses, the first microprocessor 110 will communicate with the second microprocessor 120 to indicate that the control sequence is complete. When the second microprocessor 120 confirms that a similar control sequence for acceleration data is complete, the two microprocessors can communicate with the trigger control unit 150 which can generate the low voltage control signal 210.

In other embodiments, the transducer 130 is configured to provide data on pressure and/or optionally temperature. In such embodiments, the first microprocessor 110 may include measurements of both temperature and pressure in the control sequence. It will be appreciated that the particular sequence phases, measurements and thresholds used in the control sequence will depend upon the application of the downhole device 10.

Furthermore, it will be appreciated that, in some embodiments, the corresponding control sequence of the second microprocessor 120 utilises acceleration measurements taken from the accelerometer 190 to progress through the sequence. As for the control sequence of the first microprocessor 110, it will be appreciated that the particular sequence phases, measurements and thresholds used in the control sequence will depend upon the application of the downhole device 10. Furthermore, pulses of acceleration, such as movement of the tool by movement of the slickline or other mechanism, can be used to progress the control sequence, therefore providing additional levels of configuration of the control of the downhole tool.

It will be appreciated that the elements of the downhole device 10 shown are not an exhaustive list of the elements that can be used in the device. In other arrangements, additional modules that perform functionality beyond those described here may be utilised. Furthermore, the order in which the modules are arranged in the layout detailed herein is used merely to represent the modular layout of the elements of the downhole device described herein. Indeed, it is well within the capabilities of the skilled person to re-arrange the order of the modules and to alter the attachment and layout of the modules to include additional functionality.

Those skilled in the art will appreciate that while the foregoing has described what are considered to be the best mode and, where appropriate, other modes of performing the invention, the invention should not be limited to specific apparatus configurations or method steps disclosed in this description of the preferred embodiment. It is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Those skilled in the art will recognize that the invention has a broad range of applications, and that the embodiments may take a wide range of modifications without departing from the inventive concept as defined in the appended claims.

While the invention has been described with a certain degree of particularity, changes may be made in the details of construction and the arrangement of components without departing from the spirit and scope of this disclosure. Therefore, the invention is not limited to the embodiments described herein, but is limited only by the scope of the attached claims, including the full range of equivalency to which each element thereof is entitled.

The invention claimed is:

1. A downhole control device configured to activate downhole equipment requiring control signals, the device comprising:

a housing adapted to protect electronic components;

a transducer configured to measure one or more of pressure and temperature;

an accelerometer;

control circuitry in communication with the transducer and the accelerometer and configured to control operation of a downhole tool depending on data from one or more of said transducer and said accelerometer; and a sub-module configured to releasable connect to an open end of the housing so as to form a seal to the external environment, the sub-module being configured with a hollow channel to provide a pressure pathway from the external environment in order to present external pressure to the transducer;

wherein the transducer, the accelerometer and at least part of the control circuitry are mounted on a chassis; and wherein the chassis is removably inserted within the housing.

2. A downhole control device according to claim 1, wherein the chassis comprises a single piece chassis which supports all of the transducer, accelerometer and associated control circuitry.

3. A downhole control device according to claim 1, wherein the transducer is releasably engaged with an adaptor which is releasably engaged with the chassis.

4. A downhole device according to claim 3, wherein the adaptor is configured to allow a transducer signal to pass to the control circuitry in isolation from an external environment.

5. A downhole control device according to claim 1, wherein the housing is a first module of a modular assembly and the device comprises further modules, releasably connected to each other.

6. A downhole control device according to claim 1, wherein the downhole tool comprises a detonator.

7. A downhole control device according to claim 1, wherein the downhole tool is a data logger configured to log data from the transducer and the accelerometer.

8. A downhole control device according to claim 1, wherein the control circuitry generates a low voltage control signal.

9. A downhole control device according to claim 8, further comprising a voltage generator configured to generate a higher voltage control signal to control the downhole tool in response to the low voltage control signal from the control circuitry.

10. A downhole control device according to claim 1, wherein the control circuitry, the accelerometer and the pressure transducer are calibrated before the downhole device is assembled.

11. A downhole control device according to claim 1, wherein the chassis comprises an insert configured to be removably inserted into said downhole control device;

and wherein at least part of the control circuitry is calibrated for use with the transducer and the accelerometer.

12. A method of refurbishing a downhole device, said method comprises the step of removing an insert according to claim 11 from the downhole device and replacing the insert with a replacement insert.

13. A method of refurbishing downhole equipment comprising a downhole control device according to claim 1 and a downhole tool, said method comprises the step of removing the chassis from the housing and replacing the removed chassis with a replacement chassis to form the downhole control device.

14. A downhole control device configured to activate downhole equipment requiring control signals, the device comprising:

a housing adapted to protect electronic components;

transducer configured to measure one or more of pressure and temperature;

an accelerometer;

control circuitry in communication with the transducer and the accelerometer and configured to control the operation of a downhole tool depending on data from one or more of said transducer and said accelerometer; and a voltage generator configured to generate a higher voltage control signal to control the downhole tool in response to a low voltage control signal generated by the control circuitry;

wherein the transducer, the accelerometer and at least part of the control circuitry are mounted on a chassis; and wherein the chassis is removably inserted within the housing.

15. A downhole control device according to claim 14, further comprising a sub-module configured to releasably connect to an open end of the housing so as to form a seal to the external environment and the sub-module is configured with a hollow channel to provide a pressure pathway from the external environment in order to present external pressure to the transducer.

* * * * *